United States Patent [19]

Watanabe

[11] Patent Number: 4,711,557

[45] Date of Patent: Dec. 8, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 899,029

[22] Filed: Aug. 22, 1986

[30] Foreign Application Priority Data

Sep. 6, 1985 [JP] Japan ..... 60-197124
Nov. 26, 1985 [JP] Japan ..... 60-265501

[51] Int. Cl.[4] ..... G03G 15/00

[52] U.S. Cl. ..... 355/14 R; 355/7; 355/3 R

[58] Field of Search ..... 355/14 R, 3 R, 8, 7; 358/300

[56] References Cited

U.S. PATENT DOCUMENTS 3,620,618 11/1971 White ..... 355/7 X
4,167,324 9/1979 Wu ..... 355/3 R
4,251,152 2/1981 Miyakawa ..... 355/3 R
4,268,164 5/1981 Yajima et al. ..... 355/41
4,303,332 12/1981 Sakai ..... 355/7 X
4,320,962 3/1982 Takahashi et al. ..... 355/8 X
4,371,898 2/1983 Nakamura ..... 358/300
4,380,387 4/1983 Yajima ..... 355/14 R
4,385,822 5/1983 Kanbe ..... 355/3 R
4,521,096 6/1985 Suganuma et al. ..... 355/7 X
4,637,707 1/1987 Kasahara et al. ..... 355/7 X

*Primary Examiner*—R. L. Moses
*Attorney, Agent, or Firm*—Cushman, Darby & Cushman

[57] ABSTRACT

An apparatus for forming composite images from a first original document and a second original document placed on an original table. The first original document has an item area and the second original document has an array of listed items. The first original document is copied on a copy paper and a listed item extracted from the listed items arrayed on the second original document is copied in a superimposed fashion on the item area corresponding to the first original document.

8 Claims, 48 Drawing Figures

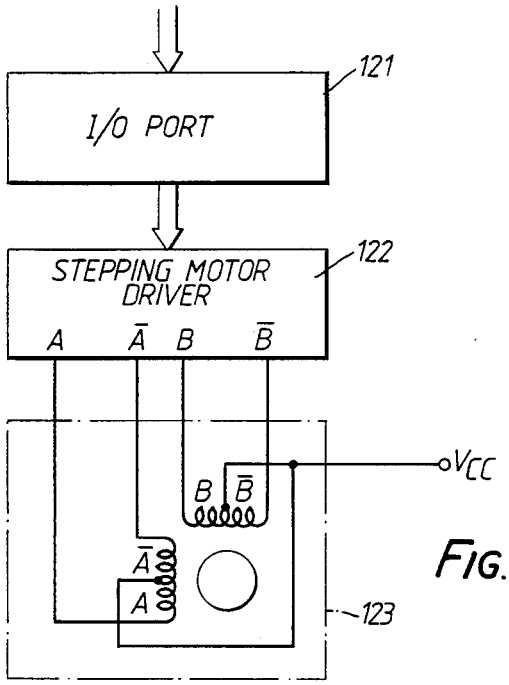
FIG. 19.
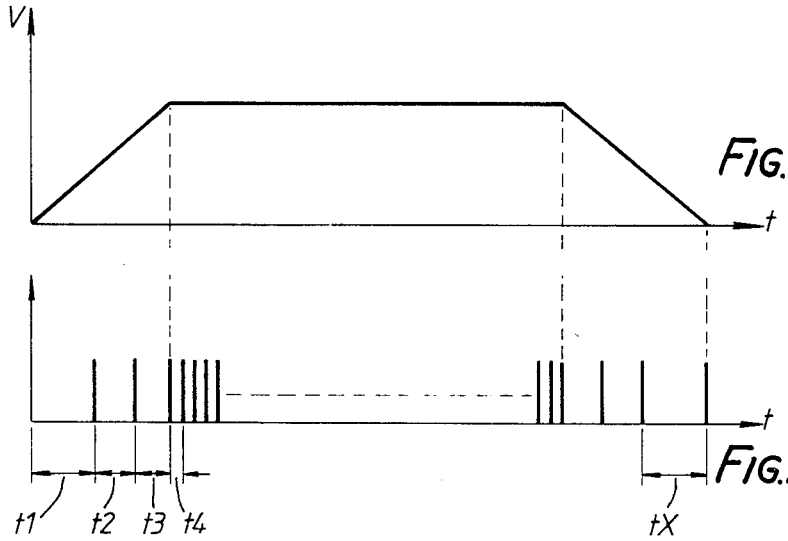
FIG. 20A.
FIG. 20B.

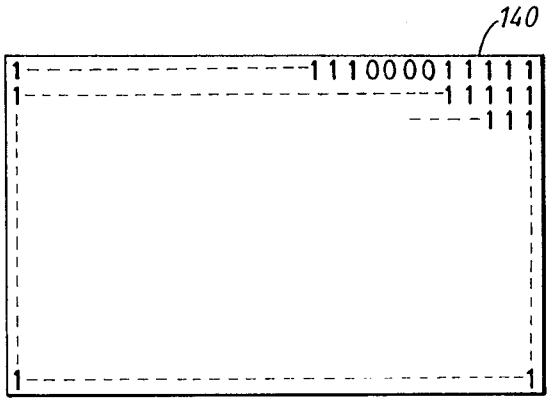
140
1
1
1

IMAGE FORMING APPARATUS

BACKGROUND OF THE INVENTION

1. Field of the Invention

The present invention relates in general to an image forming apparatus. More specifically, the invention relates to an electronic copying machine which can form an image on a copy medium by combining an image from a prescribed area of a second original document with an image from a first original document.

2. Description of the Prior Art

As is well known, copying machines have the function of copying the image on a document onto copy paper exactly as it is, or of enlarging or reducing that image.

However, when the same copy is to be distributed to a number of specified persons, their names must be written in by hand on their respective copies. This is not much trouble when the number of copies is small, but in the case of a large number of copies it does present a problem.

Moreover, when the same copy is to be distributed to a number of persons, it is customary to stamp each copy "Confidential", "For Circulation", "Copy" or the like. This presents certain problems: the appropriate stamp has to be found, it takes time to stamp the copies, and the stamps have to be prepared and stored.

SUMMARY OF THE INVENTION

It is an object of the invention to provide an improved image forming apparatus which can form an image on a copy medium by combining an image from a prescribed area of a second original document with an image from a first original document.

It is another object of the invention to provide an image forming apparatus wherein the position at which a portion of an image of the second document is inserted on a copy of the first document can be designated simply by designating its center point.

According to one aspect of the present invention, there is provided an image forming apparatus including: an original table on which first and second original documents are placed. The first original document has a selectively definable item area, and the second original document has listed items arrayed thereon; an original scanner, movable along the original table, optically scans the first and second original documents placed on the original table and forms reflected light images thereof which are focused onto an image carrier. A first image forming device forms electrostatic latent images corresponding to the images of the first and second original documents on the image carrier. Also a second image forming device develops visible images on an image forming medium corresponding to the electrostatic latent images.

It is further possible to change the position at which the image corresponding to the second original document is positioned on the image carrier. An image erasing device permits the selectively erasing of portions of the electrostatic latent image formed by the first image forming device. Apparatus is provided for feeding the image forming medium after a visible image of the first original document has been produced thereon back for forming a further image. A memory stores positional data of the item area and sizes of listed items arrayed on the second original document.

Finally, a controller coordinates the operation of the various components. Thus, a visible image of the first original document is formed on the image forming medium. Then, the position at which the image corresponding to the second original is changed so that an image of one of the listed items on the second original is directed onto the image carrier.

The electrostatic latent image of all but the one listed item focused on the image carrier is erased to allow the formation of a visible image of the one listed item on the area of the image forming medium corresponding to the item area. Finally, the image forming medium on which the visible image of the first original document is formed is positioned so that the item area of the first original document and the visible image of the listed item on the second original document approximately coincide.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawings of which:

FIGS. 1–31 show a first embodiment of an image forming apparatus according to the present invention, in which:

FIGS. 1 and 2 are plan views showing the respective positions in which the documents are placed;

FIGS. 7 and 8 are schematic perspective view and a side sectional view, respectively, showing the construction of the image forming apparatus;

FIG. 9 is a plan view of the layout of the control panel;

FIG. 10 is an oblique view of the construction of the drive unit;

FIG. 11 is an oblique view showing in outline the drive mechanism of the optical system;

FIG. 12 is an oblique view showing in outline the drive mechanism of the pointers;

FIG. 13 is an oblique view of the variable magnification lens block, showing the essential parts only;

FIG. 15. is a block diagram showing the overall control circuit;

FIG. 16 is a block diagram of the main processor group;

FIG. 17 is a block diagram of the first subprocessor group;

FIG. 18 is a block diagram of the second subprocessor group;

FIG. 19. is an outline block diagram of the stepping motor control circuit;

FIGS. 20A and 20B explain how the speed of the pulse motors is controlled;

FIG. 21 is an oblique view of an essential part, showing the spotlight source;

FIG. 22 is a lateral section of an essential part, showing the spotlight source;

FIGS. 23 and 24 are plan views explaining how the spotlight source is used to designate an area of a document to be erased;

FIG. 25 is a lateral section showing the positioning of the erasure array;

FIGS. 26 and 27 are perspective view and a front view, respectively, of only the principal part of the erasure array, showing the relationship between the erasure array and a photosensitive drum;

FIG. 29 is a circuit diagram showing the layout of the array drive unit;

FIG. 30 is a diagram explaining the contents of the memory;

FIG. 31 is a lateral section of an essential part showing an example of a different positioning of the erasure array;

FIGS. 32–37 show a second embodiment of an image forming apparatus according to the present invention, in which:

FIG. 32 in a plan view showing the respective positions in which the documents are placed;

FIG. 35 is plan view for explaining memory contents;

FIG. 37 is a plan view of the layout of the control panel.

DETAILED DESCRIPTION OF THE PREFERRED EMBODIMENTS

One of the preferred embodiments of the present invention will be described with reference to the accompanying drawings.

Figure 7:
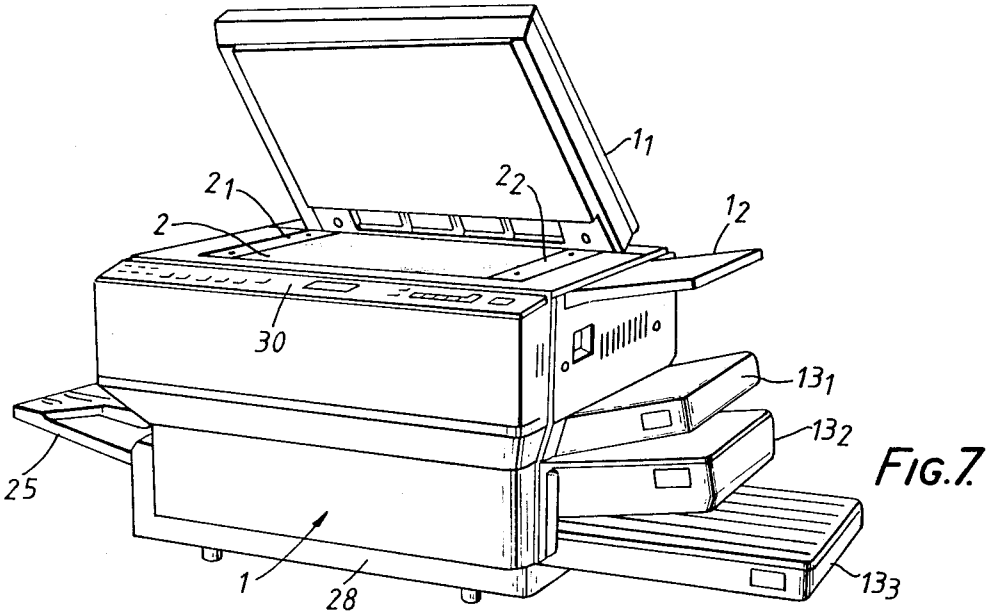
Figure 8:
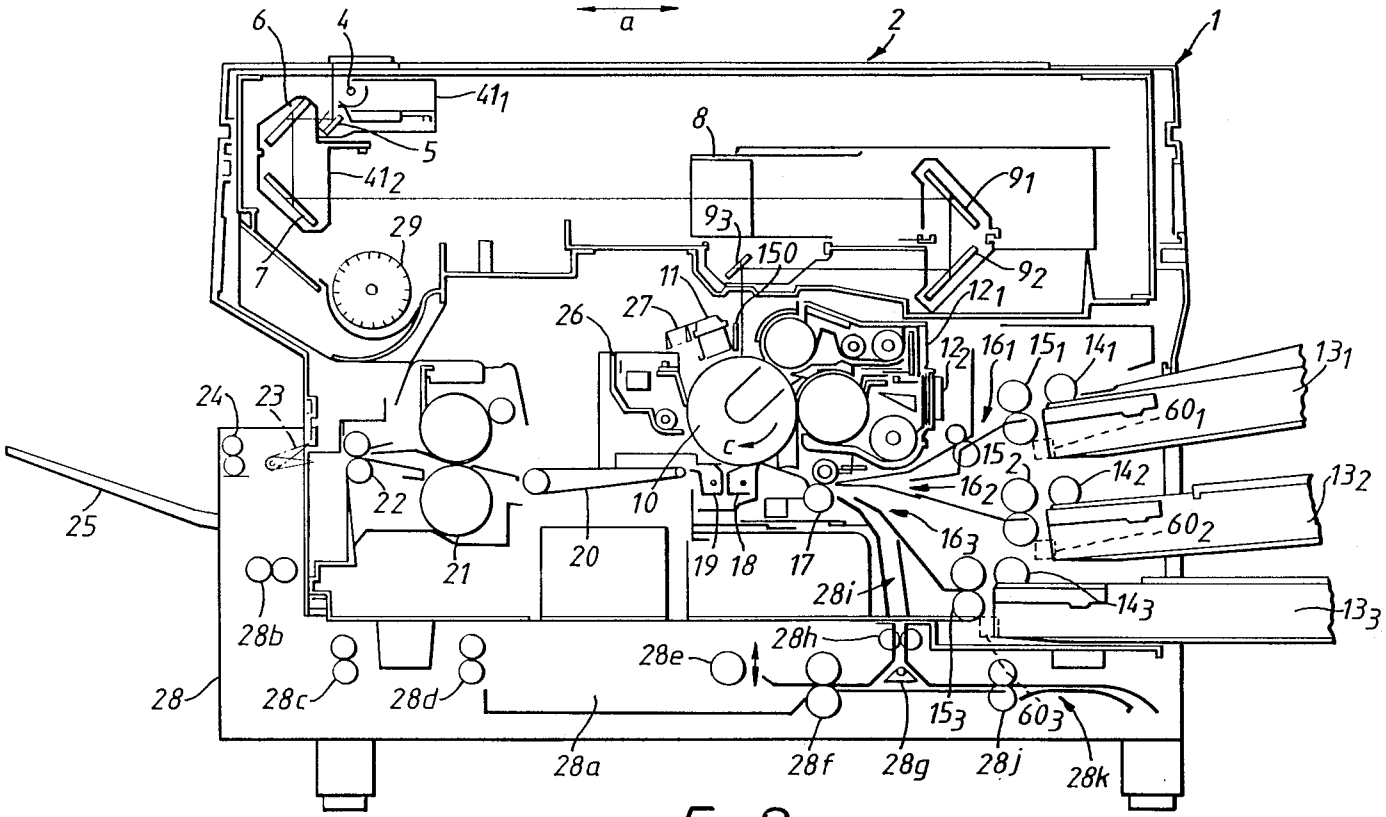

FIGS. 7 and 8 schematically show a copying machine as an image forming apparatus according to a first embodiment of the present invention. Reference number 1 denotes a copying machine housing. An original table 2 (i.e., a transparent glass) which support the original documents is provided on the upper surface of housing 1. Original table 2 has at least two original documents areas capable of holding at least two documents placed on respective holding area. Fixed scales $2_1$ and $2_2$ are references for setting the original documents respectively at opposite ends of original table 2 along the longitudinal direction thereof. An openable original cover $1_1$ and a work table $1_2$ are provided close to original table 2.

The original documents placed on original table 2 are scanned by an optical system consisting of an exposure lamp 4 and mirrors 5, 6 and 7 moving reciprocatively in the direction of the arrow a along the underside of original table 2. In this case, mirrors 6 and 7 move at half the speed of mirror 5 so as to maintain a fixed optical path length. The light reflected from the original document as a result of the scanning by the optical system, i.e., the light reflected from the original document as a result of illumination by the light from exposure lamp 4, passes through a lens block 8 capable of providing various different magnifications after being reflected by mirrors 5, 6 and 7, and is then guided to a photosensitive drum from 10 by reflection from mirrors $9_1$, $9_2$ and $9_3$, to form an image of the original document on the surface of photosensitive drum 10.

Photosensitive drum 10 rotates in the direction indicated by arrow c so that its surface is wholly charged first by a main charger 11. The image of the original document is projected on the charged surface of photosensitive drum 10 by slit exposure, forming an electrostatic latent image on the surface. The electrostatic latent image is converted into a visible image by the adhesion of, for example, red or black toner, stored in and selectively applied by developing devices $12_1$ and $12_2$ as required.

Copy paper sheets P are delivered one by one from a selected one of an upper paper-feed cassette $13_1$, middle paper-feed cassette $13_2$ or lower paper-feed cassette $13_3$, by paper-supply roller $14_1$, $14_2$ or $14_3$ and a pair of roller $15_1$, $15_2$ or $15_3$. Sheets P are guided along paper guide path $16_1$, $16_2$ or $16_3$ to an aligning roller pair 17. Then, each copy paper sheet P is delivered to a transferring station by the aligning roller pair 17, timed to the formation of the visible image.

Paper-feed cassettes $13_1$, $13_2$ and $13_3$ are removably attached to the lower part of the right side of housing 1, and any of them can be selected by operating a control panel which will be described in detail later. The cassette size of each of paper-feed cassettes $13_1$, $13_2$ and $13_3$ is detected by cassette size detecting switches $60_1$, $60_2$ and $60_3$. These cassette size detecting switches $60_1$, $60_2$, and $60_3$ are each formed of a plurality of microswitches which are turned on or off in response to insertion of cassettes of different sizes.

Paper sheet P delivered to the transferring station comes into intimate contact with the surface of photosensitive drum 10, in the space between a transfer charger 18 and drum 10. As a result, the toner image on photosensitive drum 10 is transferred to paper sheet P by charger 18. After the transfer, paper sheet P is separated from photosensitive drum 10 by a separation charger 19 and transported by a conveyor belt 20. As paper sheet P passes through a fixing roller 21, the transferred image is fixed on paper sheet P. After the fixation, paper sheet P is discharged by a pair of delivery rollers 22, a director gate 23 operated in the position shown by the solid line, and pair of discharge rollers 24 onto a tray 25 outside housing 1. After the transfer, any toner remaining on the surface of photosensitive drum 10 is removed by cleaner 26. Thereafter, any image remaining on drum 10 is erased by a discharge lamp 27 to restore the initial state. Numeral 29 designates a cooling fan for preventing the temperature inside housing 1 from rising.

A multicopying unit 28, which permits copying on both sides of a paper sheet, or multiple copies on the same side, is provided at the bottom of housing 1. Thus unit 28 is provided with pairs of rollers 28*b*, 28*c* and 28*d* which guide the copy paper, which has been initially directed to unit 28 by director gate 23 and discharge roller 24, to a storage part 28*a*. It is provided also with a delivery roller 28*e* for delivering paper which has been temporarily stored in storage part 28*a*. This delivery roller 28*e* can move up or down in the direction of the arrow in the drawing, according to the thickness (number of paper sheets) of the paper stored. The paper sheet delivered by delivery roller 28*e* is guided, via a pair of separating rollers 28*f* which separate one sheet at a time, to a control gate 28*g*. When multiple copying is required, this control gate 28*g* turns in the direction of the arrow M in the drawing, and the paper sheet is conveyed via the pair of conveyor rollers 28*h* and a paper guide route 28*i* to aligning roller pair 17. When copying on both sides is required, the paper is guided via a pair of conveyor rollers 28*j* to a reversing unit 28*k*, control gate 28*g* turns in the direction of arrow T in the drawing, and the paper sheet, sent by conveyor rollers 28*j*, is guided via conveyor rollers 28*h* and paper guide route 28*i* to aligning roller pair 17. In this embodiment, control gate 28*g* is normally turned in the direction of arrow M, permitting multiple copying only.

Figure 9:
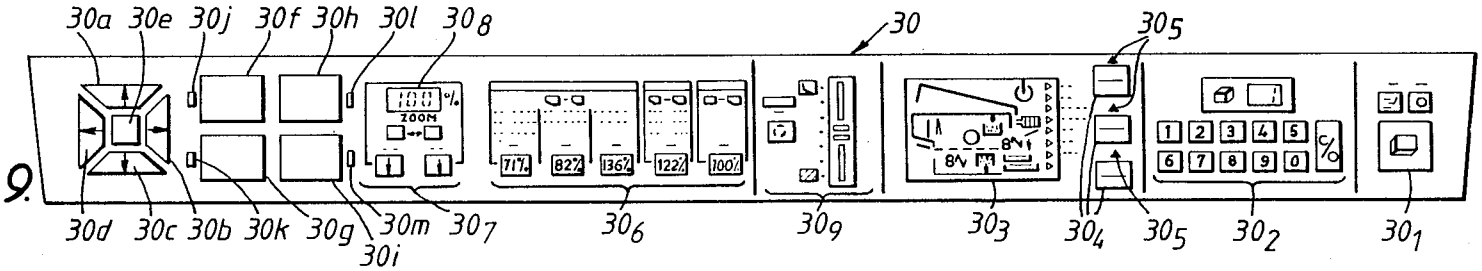

FIG. 9 shows a control panel 30 provided on housing 1. Control panel 30 carries thereon a copy key $30_1$ for starting the copying operation, a keyboard $30_2$ for setting the number of copies to be made and the like, a display section $30_3$ for indicating the operating conditions of the individual parts or paper jamming, cassette selection keys $30_4$ for selecting upper, middle or lower paper cassette $13_1$, $13_2$ or $13_3$, and cassette display sections $30_5$ for indicating the selected cassette. Control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally, arranged on control panel 30 are operation keys 30*a*, 30*b*, 30*c* and 30*d* for shifting a spot light source (mentioned later) which serves to indicate an inserted copy portion of the original document, a position designating key 30*e* for inputting the coordinate positions indicated by the spot light source, and an insertion designating key 30*f* for altering the insertion position on a document when carrying out composite copying. A color change key 30*g* changes the color of the image to be inserted when carrying out composite copying. List designating keys 30*h* and 30*i* allow selection of the first or second array pitch of the item images on a second original document $G_2$ (described later) to be inserted. Light-emitting elements 30*j*–30*m* light in response to operation of keys 30*f*–30*i*, respectively.

Figure 10:
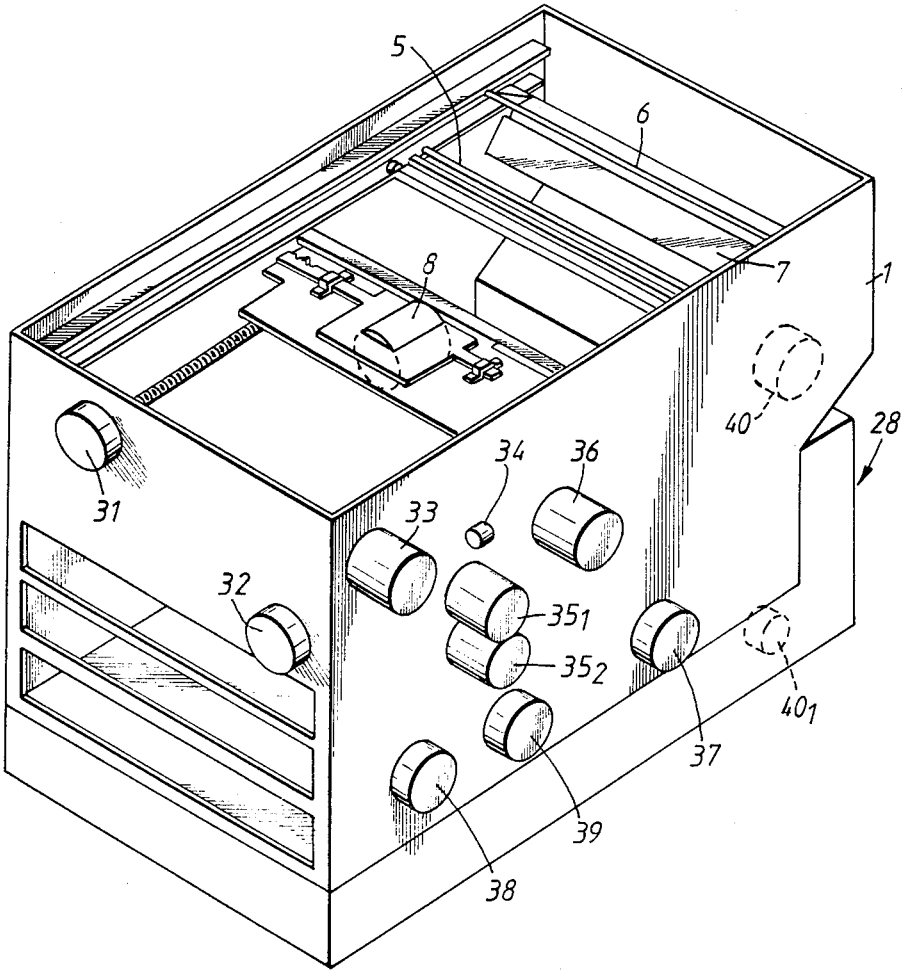

FIG. 10 shows an arrangement of the drive sources of the various drive units of the copying machine constructed as described above. The drive sources include the following motors. Lens drive motor 31 serves to shift the position of lens block 8 for magnification or reduction. Mirror drive motor 32 serves to change the distance (optical path length) between mirror 5 and mirrors 6 and 7 for magnification or reduction. Stepping motor 33 moves exposure lamp 4 and mirrors 5, 6 and 7 for scanning the original document. Shutter drive motor 34 moves a shutter (not shown) for adjusting the width of charging of photosensitive drum 10 by charger 11 at the time of magnification or reduction.

Developing motors $35_1$ and $35_2$ drive the developing rollers and the like of developing units $12_1$ and $12_2$. Drum drive motor 36 drives photosensitive drum 10. Fixing motor 37 drives paper conveyer belt 20, fixing rollers 21 and paper discharge rollers 24. Paper supply motor 38 drives paper supply rollers $14_1$–$14_3$. Sheet feed motor 39 drives aligning roller pair 17. Fan drive motor 40 drives cooling fan 29. Motor $40_1$ drives rollers 28*b*, 28*c* and 28*d*.

Figure 11:
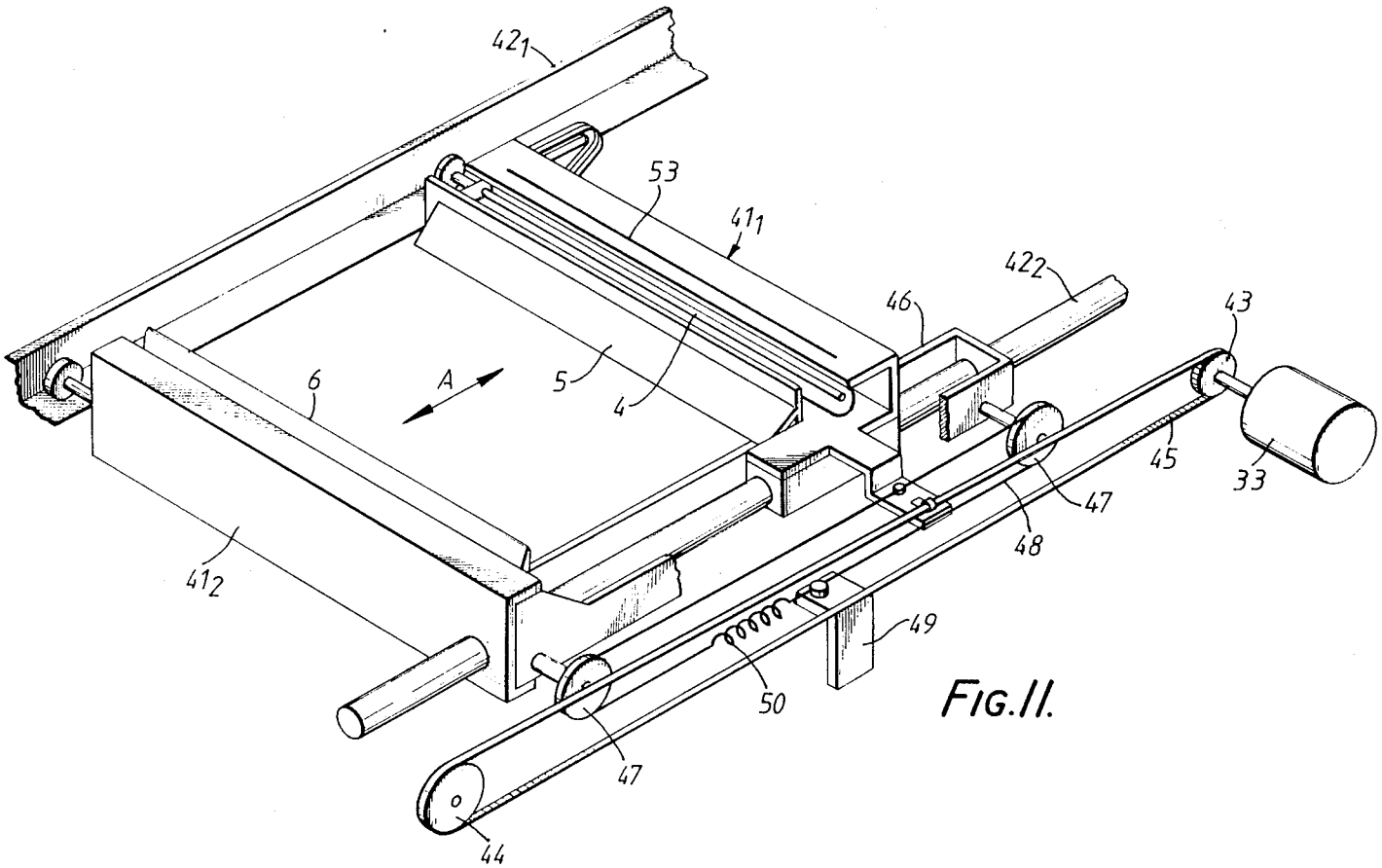

FIG. 11 shows a drive mechanism for reciprocating the optical system. Mirror 5 and exposure lamp 4 are supported by a first carriage 41, and mirrors 6 and 7 are supported by a second carriage $41_2$. Carriages $41_1$ and $41_2$ can move in parallel in the direction indicated by arrow a, guided by guide rails $42_1$ and $42_2$. For-phase pulse motor 33 drives a pulley 43. An endless belt is stretched between pulley 43 and an idle pulley 44, and one end of first carriage $41_1$ supporting mirror 5 is fixed to the middle portion of belt 45.

Two pulleys 47 are rotatably attached to a guide portion 46 (for rail $42_2$) of second carriage $41_2$ supporting mirrors 6 and 7, spaced in the axial direction of rail $42_2$. A wire 48 is stretched between pulleys 47. One end of wire 48 is connected directly to a fixed portion 49, while the other end is connected thereto by means of a coil spring 50. Coil spring 50 serves to give a tension to wire 48 for stretching wire 48 tightly between pulleys 47. One end of first carriage $41_1$ is fixed to the middle portion of wire 48.

With this arrangement, when pulse motor 33 is driven, belt 45 turns around to move first carriage $41_1$. As first carriage $41_1$ travels, second carriage $41_2$ also travels. Since pulleys 47 then serve as movable pulleys, second carriage $41_2$ travels in the same direction as and at half the speed of first carriage $41_1$. The traveling direction of first and second carriage $41_1$ and $41_2$ is controlled by changing the rotating direction of pulse motor 33.

Original table 2 carries thereon an indication of a reproducible range corresponding to the size of designated paper sheets. If the sheet size designated by cassette selection keys $30_4$ and the copy ratio specified by ratio setting keys $30_6$ and $30_7$ are (Px, Py) and K, respectively, the reproducible range (x, y) is given by $$x = Px,K,$$

$$y = Py/K.$$

Of this reproducible range (x, y), the x direction is indicated by pointers 51 and 52 (see FIG. 12) disposed on the reverse side of original table 2, while y direction is indicated by a scale 53 provided on the top surface of first carriage $41_1$ so as to be visible through the glass of table 2.

Figure 12:
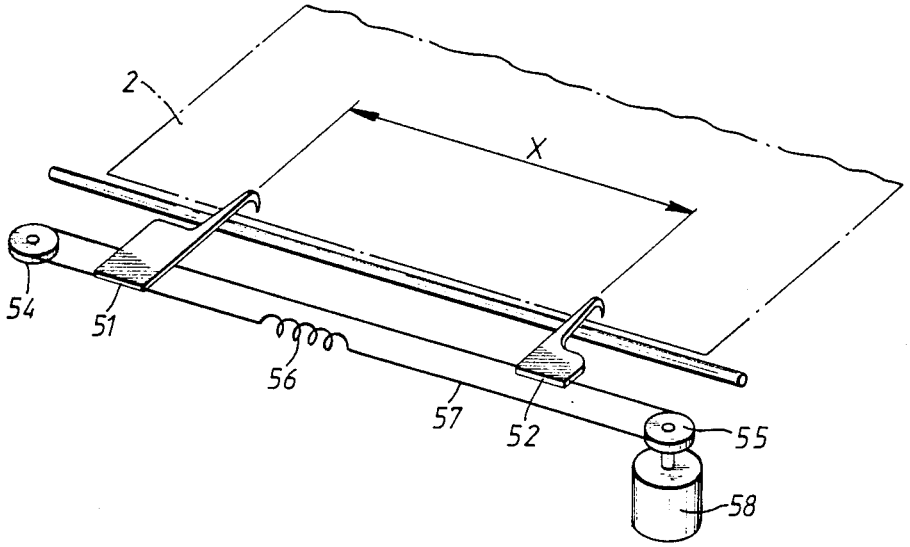

As shown in FIG. 12, pointers 51 and 52 are attached to a wire 57 which is stretched between pulleys 54 and 55 through the aid of a spring 56. Pulley 55 is rotated by a motor 58. The distance between pointers 51 and 52 can be changed by driving motor 58 in accordance with the sheet size and the enlargement or rèduction ratio.

First carriage $41_1$ moves to a predetermined position (home position depending on the enlargement or reduction ratio) as motor 33 is driven in accordance with the sheet size and the ratio. When copy key $30_1$ is depressed, first carriage $41_1$ is first moved toward second carriage $41_2$. Then lamp is lighted and first carriage $41_1$ is moved away from second carriage $41_2$. When the original scanning ends, lamp 4 is turned off, and first carriage $41_1$ is returned to the home position.

Figure 13:
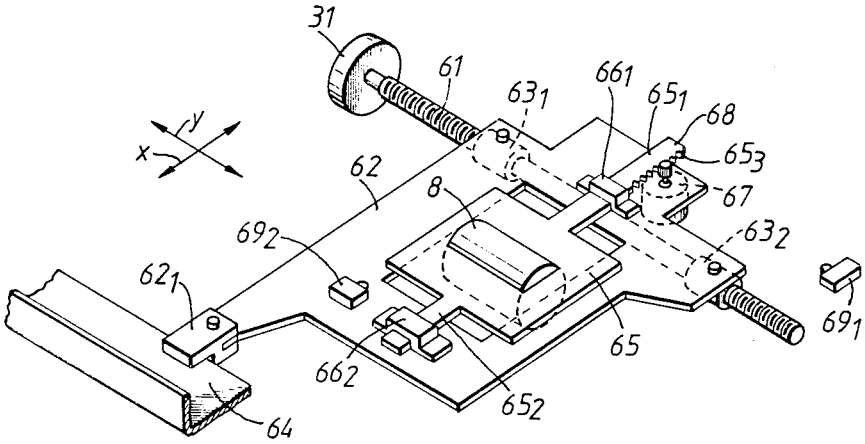

FIG. 13 shows a drive mechanism for lens block 8. Motor 31 drives a lead screw 61 arranged along the moving direction (y direction) of first carriage $41_1$. Bushings $63_1$ and $63_2$ disposed at opposite ends of a base plate 62 are threaded on screw 61. When screw 61 is rotated, plate 62 is moved along the y direction. A guide member $62_1$ is arranged at the other end of plate 62. Guide member $62_1$ is slidably engaged with a guide rail 64. A movable member 65, upon which lens block 8 is mounted, is mounted on plate 62 and is movable along a direction (x direction) perpendicular to the direction of movement of plate 62. Supports $65_1$ and $65_2$ are provided at two ends of member 65 and are guided by guide members $66_1$ and $66_2$ mounted on plate 62. A rack $65_3$ is formed on the side surface of support $65_1$ along its longitudinal direction. A pinion 68 is operatively connected to rack $65_3$ and can be rotated by a pulse motor 67 mounted on plate 62. When motor 67 is driven, lens block 8 is moved along the x direction. It should be noted that microswitches $69_1$ and $69_2$ detect the initial position of plate 62 and member 65, respectively.

Figure 14A:
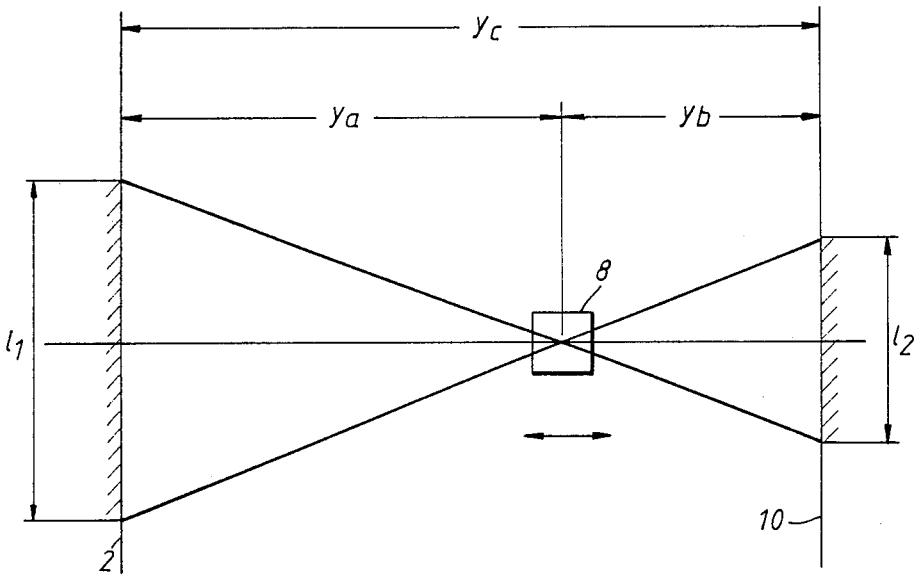
FIGS. 14A and 14B show the relation between the working of the lens block and the image which is formed.

The relationship between the operation of lens block 8 and the image to be formed will now be described. Referring to FIG. 14A, if the focal distance of lens block 8 is given by f, the optical path length between table 2 and lens block 8 is given by ya, the optical path length between lens block 8 and drum 10 is given by yb, and the overall optical path length between table 2 and drum 10 is given by yc, the following optical relation is derived $$1/f = 1/ya + 1/yb$$

A magnification K is thus given by:

$$K = yb/ya$$

Since focal distance f of lens block 8 is predetermined, it is apparent that length yc as well as length ya or yb must be changed to achieve focusing in the variable magnification mode. Length ya and yb can be varied by moving lens block 8 in the y direction. Length yc can be varied by moving second carriage $41_2$ and changing the position of mirrors 6 and 7.

Figure 14B:
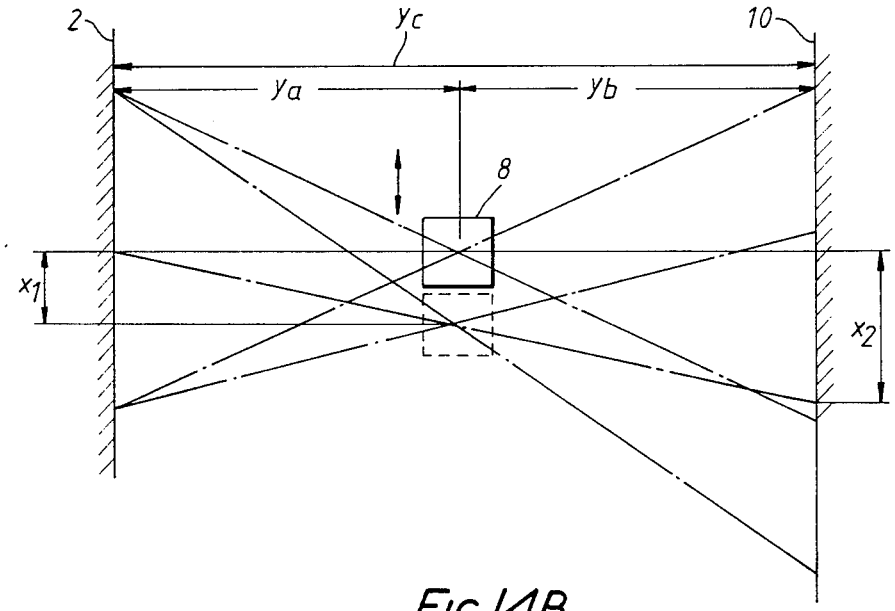

As shown in FIG. 14B, if the distance between table 2, lens block 8 and drum 10 are predetermined, and lens block 8 is moved by motor 67 by distance x1 along the x direction, an image on drum 10 can be shifted by distance x2, where x2 is given by:

$$x2 = x1\ (1+K)$$

When an equal size mode is set, distance x2 is given by:

$$x2 = 2.x1$$

In this manner, the center of the copied image can be shifted by moving lens block 8 along the x direction.

Figure 15:
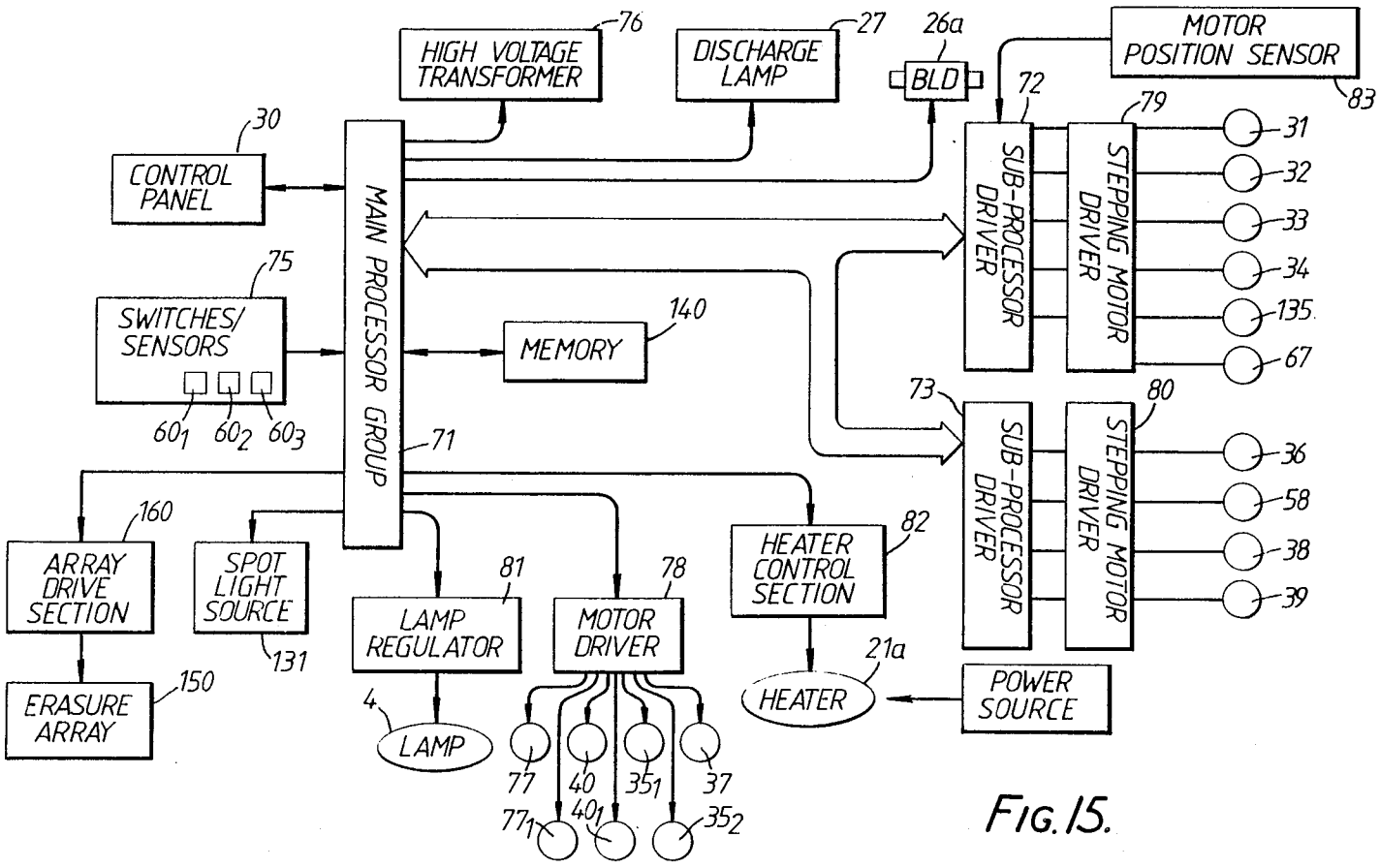

FIG. 15 shows a general circuit of the electronic copying machine. This control circuit is mainly composed of a main processor group 71 and first and second sub-processor groups 72 and 73. Main processor group 71 detects input data from control panel 30 and a group of input devices 75 including various switches and sensors, such as the cassette size detection switches $60_1$, $60_2$ and $60_3$ and controls a high-voltage transformer 76 for driving the chargers, discharge lamp 27, a blade solenoid 26a of cleaner 26, a heater 21a of fixing roller 21, exposure lamp 4, and motors 31 to 40 and 58, thus accomplishing the copying operation. Main processor group 71 also controls a spot light source 131, a stepping motor 135, an erasure array 150, an array drive section 160, and a memory 140, thereby erasing any unnecessary portions of the original document. These components 131, 150, 160 and 140 will be described in detail later.

Motor $35_1$, $35_2$, 37, 40 and $40_1$ and a toner-supply motors 77 and $77_1$ for supplying toner to developing units $12_1$ and $12_2$ are connected through a motor driver 78 to main processor group 71 to be controlled thereby. Motors 31 to 34, 67 and 135 are connected through a stepping motor driver 79 to first sub-processor group 72 to be controlled thereby. Motors 36, 38, 39 and 58 are connected through a stepping motor driver 80 to second subprocessor group 73 to be controlled thereby.

Further, exposure lamp 4 is controlled by main processor group 71 through a lamp regulator 81, and heater 21a by main processor group 71 through a heater control section 82. Main processor group 71 gives instructions for the start or stop of the individual motors to first and second sub-processor groups 72 and 73. Thereupon, first and second subprocessor groups 72 and 73 feed main processor group 71 with status signals indicative of the operation mode of the motors. Also, first subprocessor group 72 is supplied with positional information from a position sensor 83 for detecting the respective initial positions of motors 31 to 34, 67 and 135.

Figure 16:
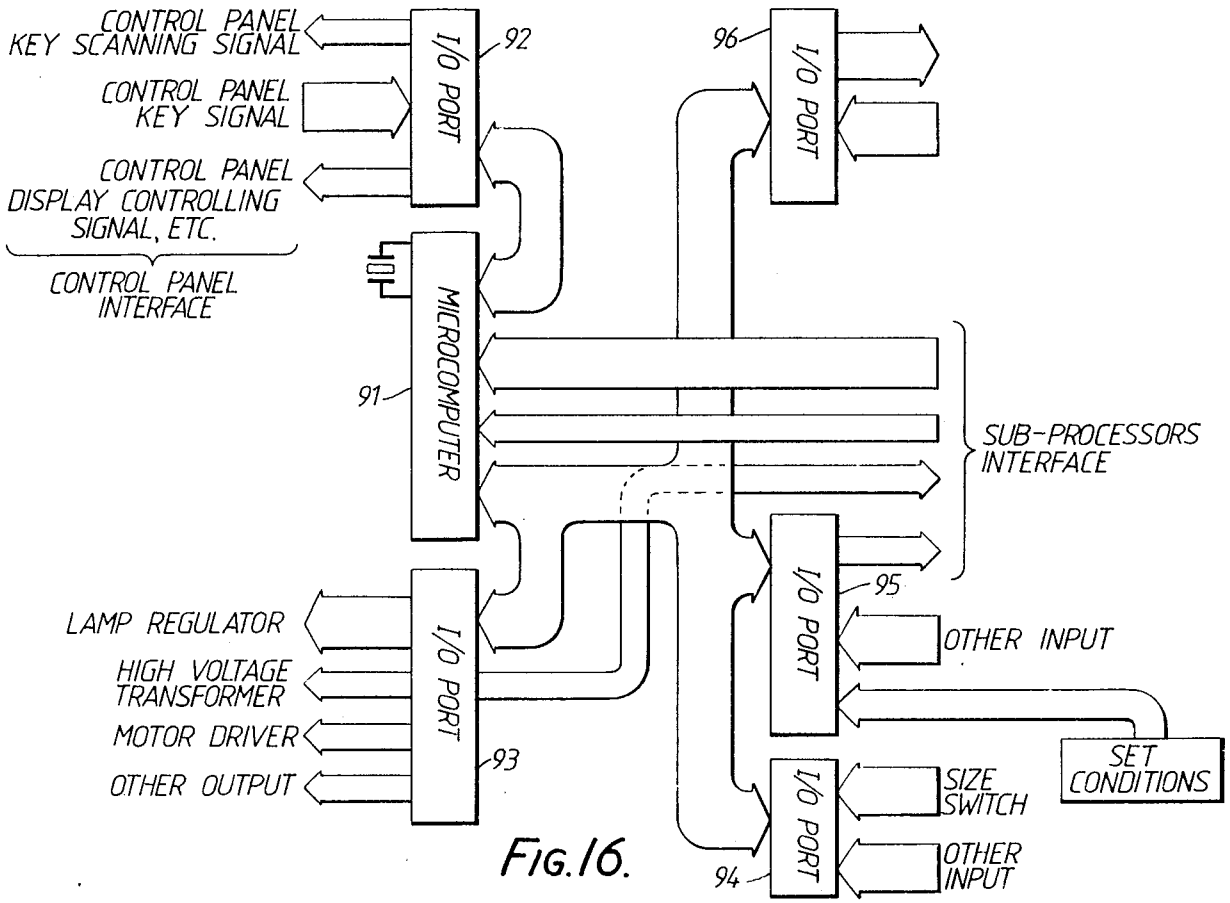

FIG. 16 shows an arrangement of main processor group 71. Reference number 91 denotes a one-chip microcomputer (to be referred to as a CPU hereinafter). CPU 91 detects key inputs at a control panel (not shown) through an I/O port 92 and controls display operations. CPU 91 can be expanded through I/O ports 93 to 96. Port 93 is connected to a high voltage transformer 76, a motor driver 78, a lamp regulator 81 and other outputs. Port 94 is connected to a size switch for detecting a paper size and other inputs. Port 95 is connected to a copying condition setting switch and other inputs. Port 96 is optional.

Figure 17:
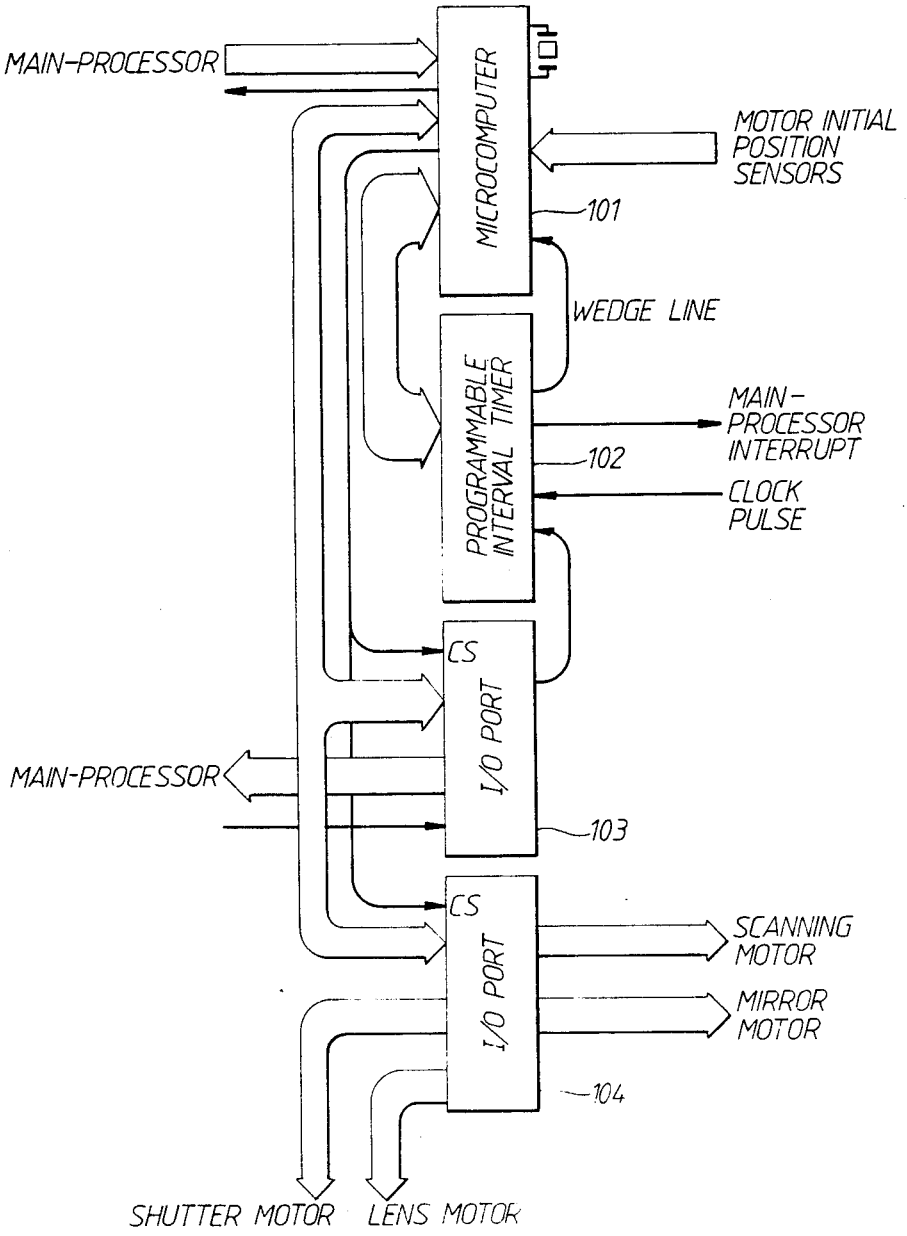

FIG. 17 shows an arrangement of first sub-processor group 72. Reference numeral 101 denotes a CPU connected to group 71. Reference numeral 102 denotes a programmable interval timer for controlling switching time intervals. A preset value from CPU 101 may be set in programmable interval timer 102, and timer 102 then times a corresponding period. When timer 102 is stopped, timer 102 sends an end pulse onto an interrupt line of CPU 101. Timer 102 receives reference clock pulses. CPU 101 receives position data from a position sensor 83 and is connected to I/O ports 103 and 104. Port 104 is connected to motors 31 to 34, 67 and 135 through stepping motor driver 79. Port 103 is used to supply a status signal from each pulse motor to group 71.

Figure 18:
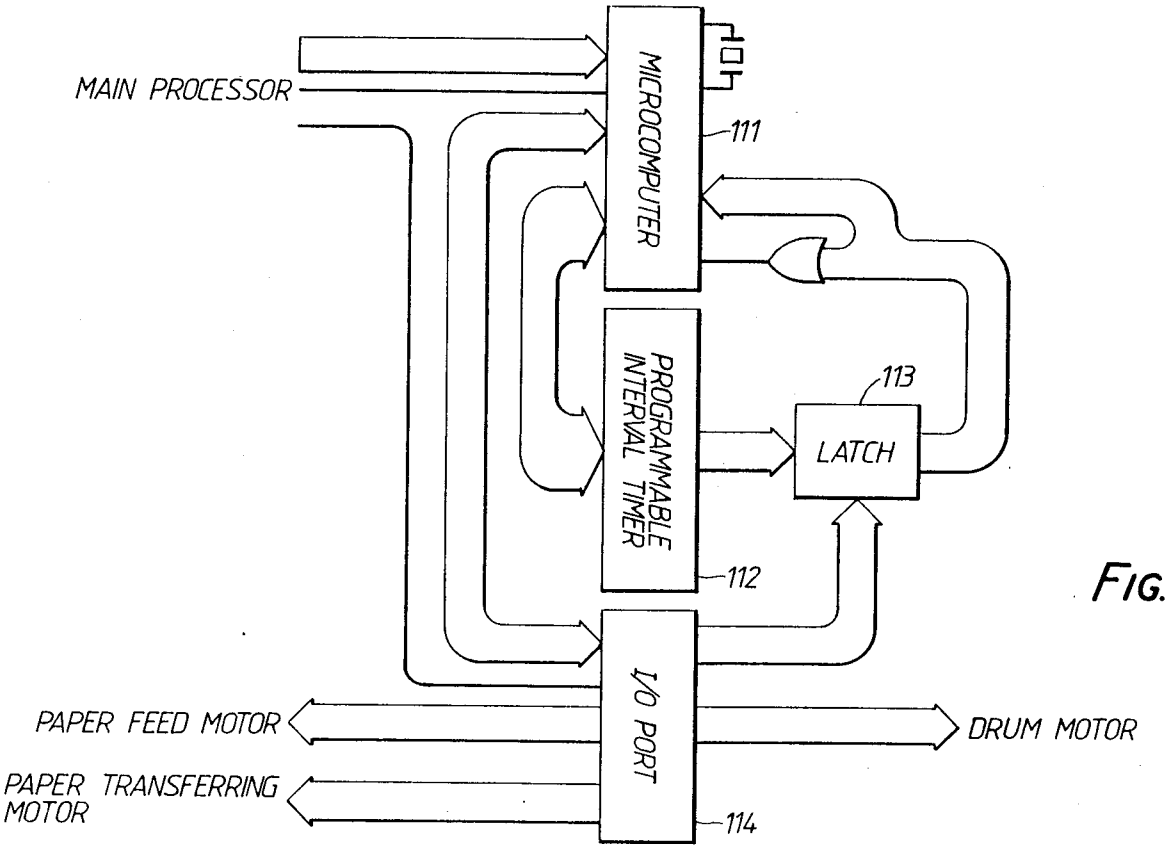

FIG. 18 shows an arrangement of second sub-processor group 73. Reference numeral 111 denotes a CPU connected to group 71. Reference numeral 112 denotes a programmable interval timer for controlling switching time intervals of the stepping motors. A preset value from CPU 111 may be set in programmable interval timer 112, and timer 112 then times a corresponding period. When timer 112 is stopped, it generates an end pulse. The end pulse is latched by a latch circuit 113, and an output therefrom is supplied onto the interrupt line of CPU 111 and the input line of the I/O port. CPU 111 is connected to an I/O port 114 which is then connected to motors 36, 38, 39 and 58 through driver 80.

FIG. 19 shows a stepping motor control circuit. An I/O port 121 (corresponding to ports 104 and 114 of FIGS. 17 and 18) is connected to a stepping motor driver 122 (corresponding to drivers 79 and 80 of FIG. 15). Driver 122 is connected to windings A, A, B and B of a stepping motor 123 (corresponding to motors 31 to 34, 36, 38, 39, 58, 67 and 135).

FIGS. 20A and 20B show a method of controlling a stepping motor speed. FIG. 20A shows a stepping motor speed curve, and FIG. 20B shows switching intervals. As is apparent from FIGS. 20A and 20B, the switching intervals are long at the beginning, are gradually decreased until a predetermined interval is reached.

When stopping is desired, the intervals are gradually increased, and the stepping motor is finally stopped. This cycle indicates the through-up and through-down of the pulse motor. The motor is started from the self starting region, operated in a high-speed region and is gradually stopped. Reference symbols t1, t2, -----, tx denote times between the switching intervals.

Indicating means according to the present invention will now be described in detail.

Figure 21:
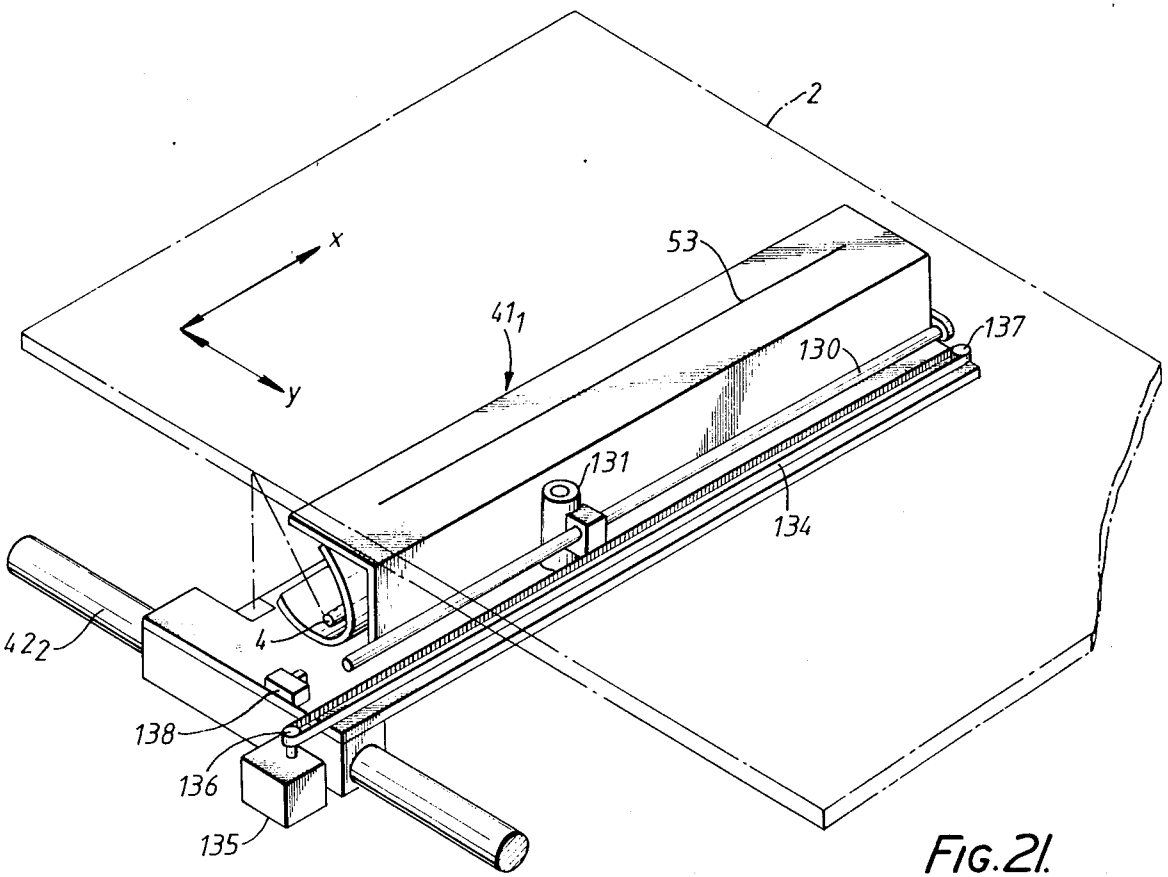
Figure 22:
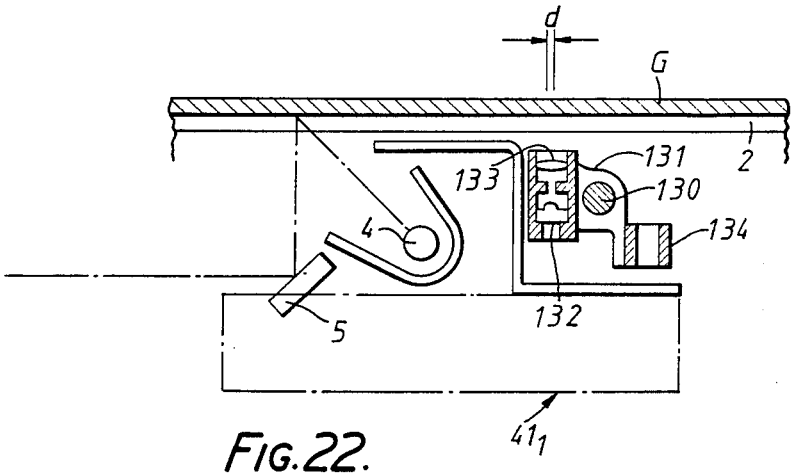

In FIGS. 21 and 22, a guide shaft 130 is disposed at that portion of the first carriage $41_1$ intercepting the light from lamp 4, extending along lamp 4. On guide shaft 130, a spot light source 131 is movably mounted as the indicating means for indicating the entry area on the first original document. As shown in FIG. 22, spot light source 131 includes a light emitting element 132, such as a light emitting diode or lamp, and a lens 133 which are opposed to original table 2.

A light beam emitted from light emitting element 132 is applied to original table 2 through lens 133, as a spot light with a diameter d of, e.g., 2 mm. The spot light has enough brightness to be transmitted through first original document G1 as thick as, e.g., a post-card set on original table 2. The spot light source 131 is coupled to a timing belt (toothed belt) 134 extending along guide shaft 130. Timing belt 134 is stretched between a pulley 136 mounted on the shaft of a stepping motor 135 and a driven pulley 137. As stepping motor 135 is rotated, spot light source 131 is moved in a direction perpendicular to the scanning direction of first carriage $41_1$. A position sensor 138 formed of a microswitch for detecting the initial position of spot light source 131 is attached to that portion of first carriage $41_1$ which is located beside the end portion of guide shaft 130 of the side of stepping motor 135. When spot light source 131 is moved, for example, it first abuts against position sensor 138 to have its initial position detected thereby.

Figure 23:
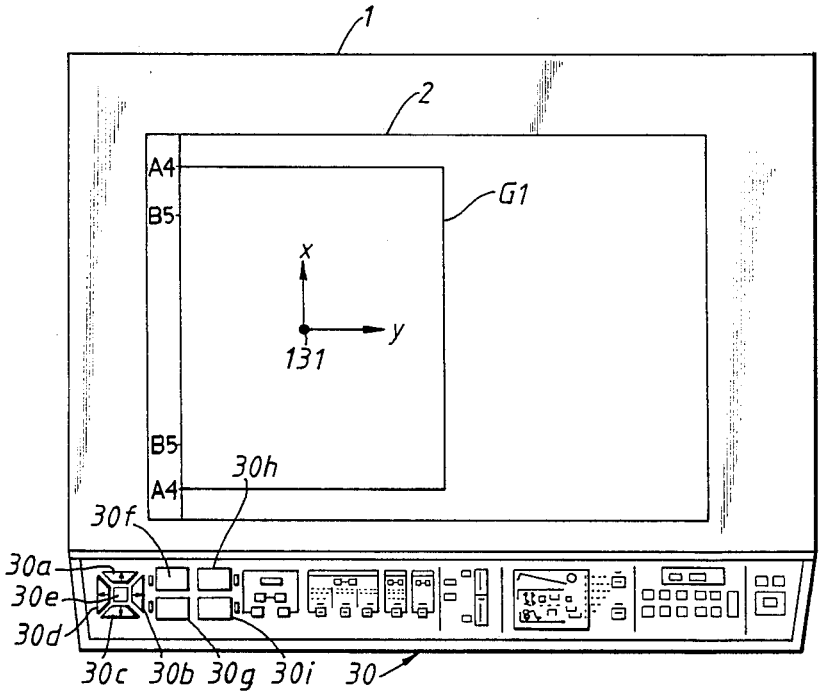
Figure 24:
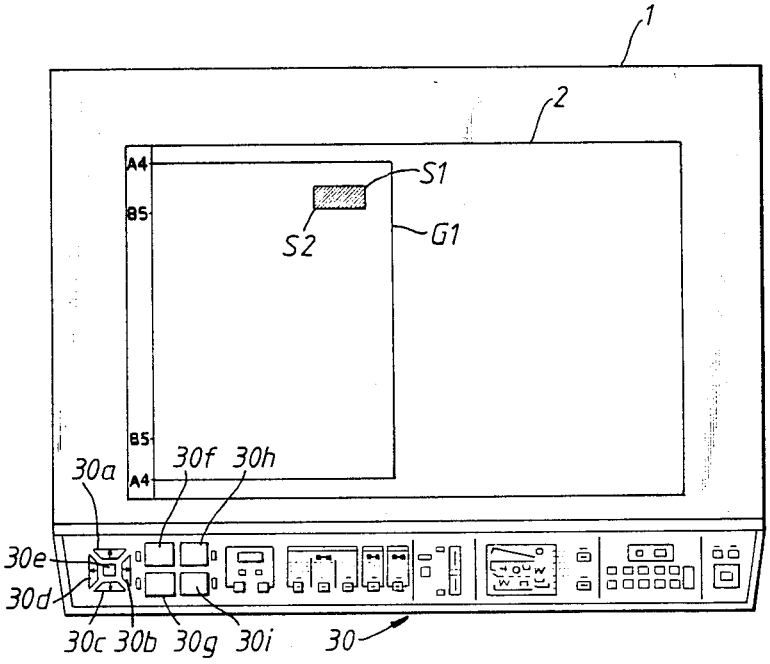

Referring now to FIGS. 23 and 24, there will be described a method for designating a given area, i.e., the entry area, on an original document by means of spot light source 131. Spot light source 131 is moved, with light emitting element 132 switched on, by operating the operation keys 30*a* to 30*d*. When the operation keys 30*b* and 30*d* are depressed, motor 33 is started, and first carriage $41_1$ and spot light source 131 are moved in the scanning direction (indicated by arrow y in FIG. 23). When the operation keys 30*a* and 30*c* are depressed, on the other hand, motor 135 is started, and spot light source 131 is moved in a direction (indicated by arrow x in FIG. 23) perpendicular to the scanning direction.

Observing the spot light transmitted through first original document G1, the operator operates the operation keys 30*a* to 30*d*. When the spot light reaches, for example, a spot S1 on original document G1 shown in FIG. 24, the operator depresses the position designating key 30*e*. Thereupon, the coordinate positional data of spot S1 is stored in memory 140 shown in FIG. 15. Likewise, if the position designating keys 30*e* is depressed when a spot S2 on original document G is reached by the spot light, the positional data of spot S2 is stored in memory 140. This position of the spot light can be detected by, for example, counting drive pulses delivered from stepping motors 33 and 135.

Figure 26:
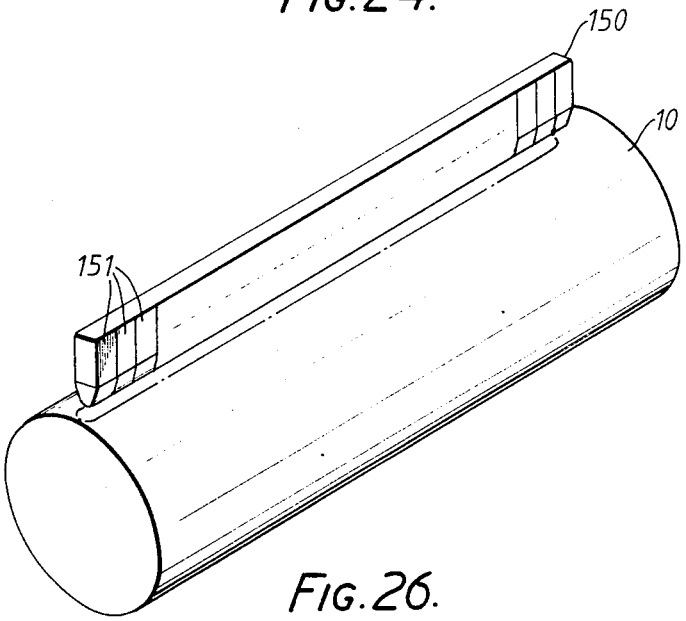
Figure 25:
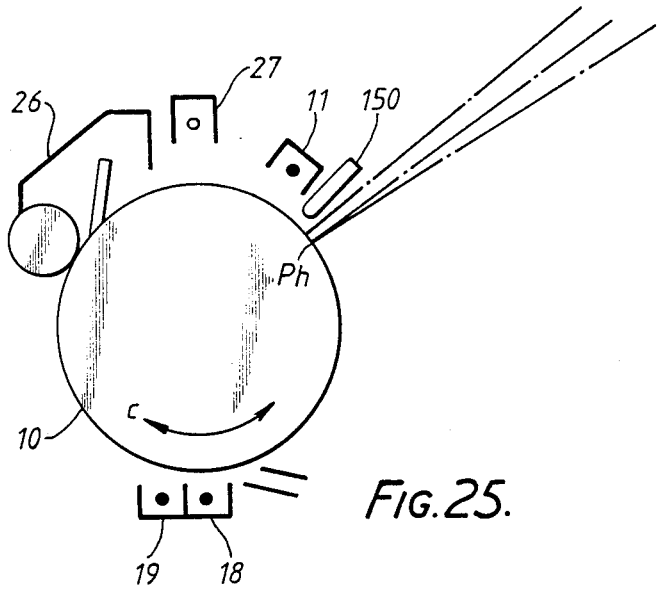
Figure 27:
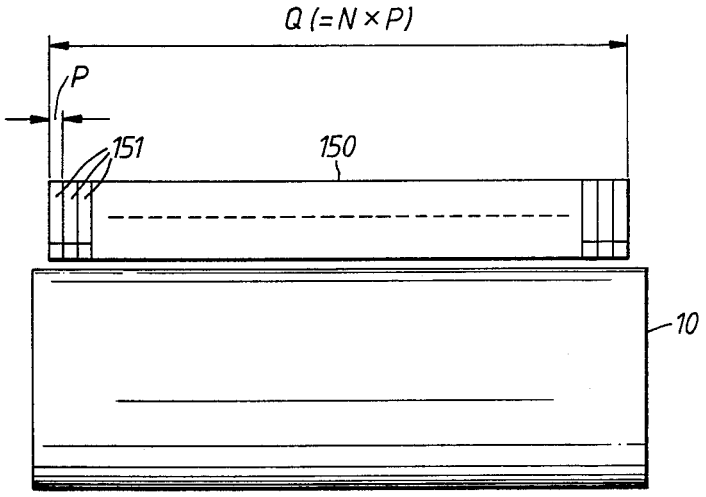
Figure 28A:
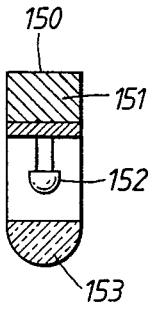
FIG. 28A is a side sectional view of the erasure array.
Figure 28B:
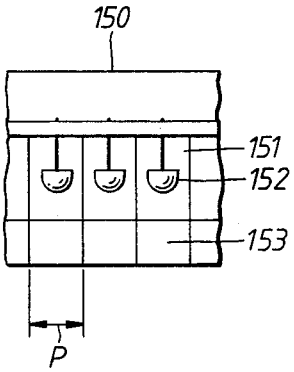
FIG. 28B is a partial front view of the erasure array.

As shown in FIG. 25, an erasure array 150 as the erasing means is disposed close to photosensitive drum 10, between charger 11 and an exposure region Ph, for example. As shown in FIGS. 26 and 27, erasure array 150 includes a plurality of shading cells 151 which are arranged in a direction perpendicular to the rotating direction of photosensitive drum 10. As shown in FIGS. 28A and 28B, cells 151 each contains therein a light emitting element 152 formed of, e.g., a light emitting diode. Moreover, a lens 153 for converging light from light emitting element 152 on the surface of photosensitive drum 10 is disposed at the opening portion of each cell 151 facing photosensitive drum 10.

The number of light-emitting elements arranged in erasure array 150 corresponds to the column capacity of memory 140. When the width of each light-emitting element 152 is given by P and the number of elements is given by N, overall length Q of array 150 is given by $Q=N \cdot P$.

Figure 29:
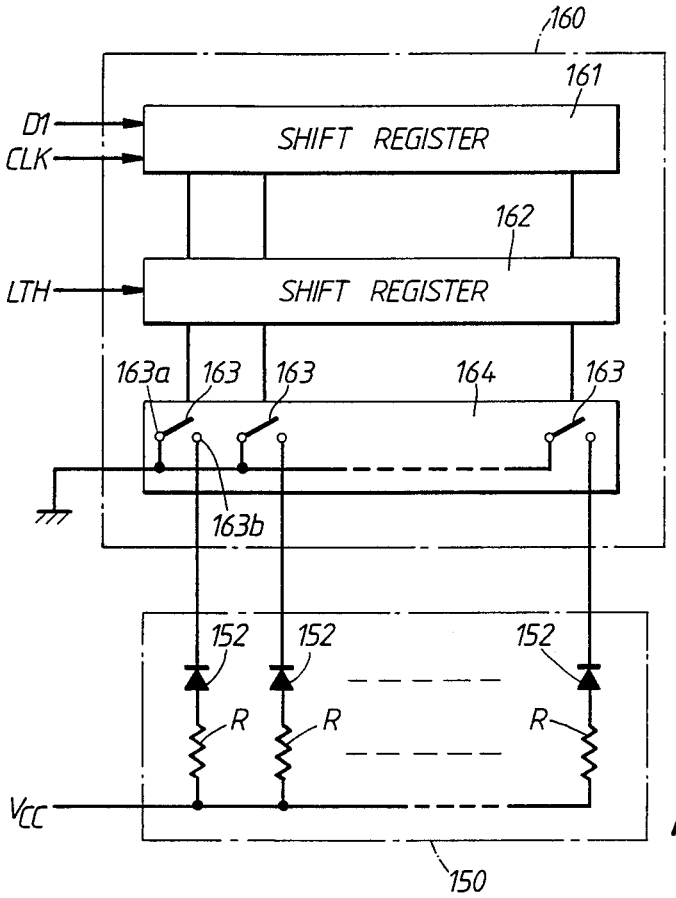

Array 150 is driven by an array drive section 160. As shown in FIG. 29, section 160 comprises a shift register 161 having the same bit number as the rank bit number of memory 140, a store register 162 for storing the content of register 161, and a switching circuit 164 consisting of a plurality of switch elements 163 which are turned on/off in response to output signals from register 162. Movable contacts 163*a* of elements 163 are grounded, and stationary contacts 163*b* thereof are respectively connected to the cathodes of elements (diodes) 152 constituting array 150. The anodes of elements 152 are connected to a power source VCC through the corresponding current limiting resistors R.

Figure 30:
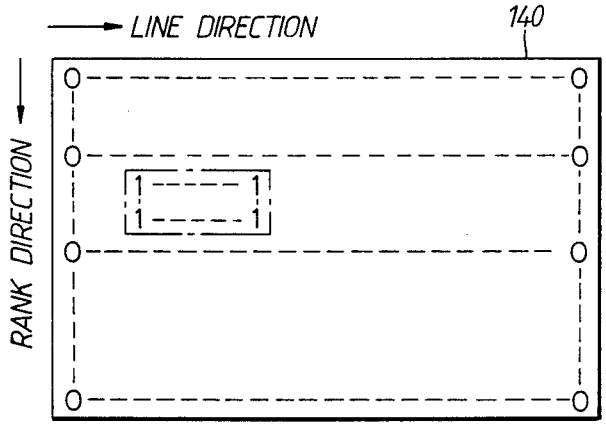

The erase data stored in memory 140 are supplied to above-mentioned shift register 161. These erase data are generated by main processor group 71 on the basis of the preset erase area, as will be described later. High level signals "1" are stored in memory 140 for parts constituting the erase area, and low level signals "0" for the other parts. Memory 140 is a RAM, of which the capacity, for example, in the column direction is matched by the number of light emitting elements 152 constituting erase array 150. It is controlled by main processor group 71 so that high level and low level signals are stored in the prescribed addresses, as indicated in FIG. 30.

The operation of erasing in the construction described above will now be explained. When first carriage $41_1$ and photosensitive drum 10 are operated, in the state in which erase data are stored in memory 140 as described above, data is read one rank at a time from memory 140 in the line direction (indicated in FIG. 30). The readout data D1 are transferred to register 161 in section 160 in response to the clock signal CLK. After one-rank data is transferred to register 161 and the changed portion of drum 10 reaches array 150, group 71 generates a latch signal LTH. The storage data is supplied from register 161 to register 162 in response to the latch signal LTH. Since array 150 is arranged between charger 11 and exposure portion Ph, the output timing of the latch signal LTH is controlled such that the one-rank data is transferred from memory 140 to register 162 prior to $\theta 1/\omega$ where $\theta 1$ is the angle between array 150 and portion Ph and $\omega$ is the peripheral velocity of drum 10.

Elements 163 in circuit 164 are controlled in response to the output signal from register 162. When the output of register 162 is set at high level, element 163 are turned on. When the output of register 162 is set at low level, elements 163 are turned off. Elements 152 connected to elements 163 are turned on when elements 163 are turned on. Otherwise, elements 152 are turned off. A charged drum portion corresponding to the ON elements 152 is discharged, and the remaining portion is not discharged, so that a latent image is not formed in the discharged portion even if the surface of drum 10 is exposed with light. In this manner, the unnecessary portion for one rank is erased. The data is thus read out from memory 140 in units of ranks, thereby erasing the unnecessary image portion.

Figure 4A:
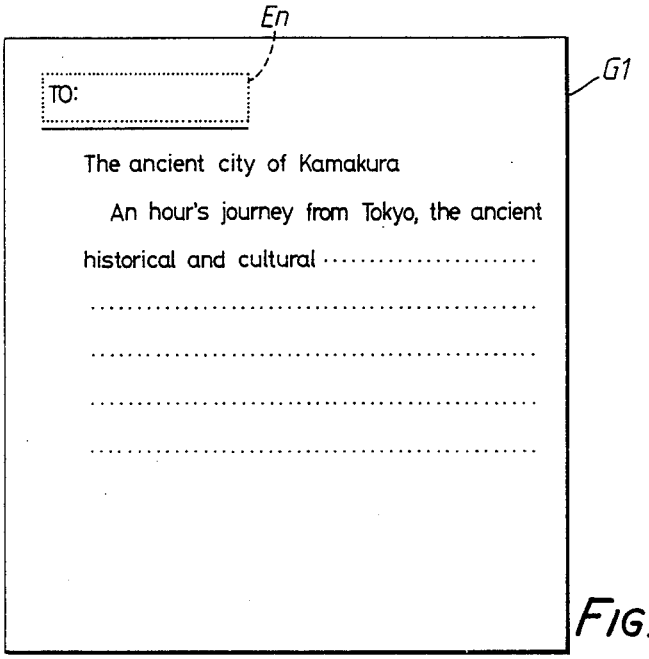
FIGS. 4A and 4B show the first and second documents respectively.
Figure 4B:
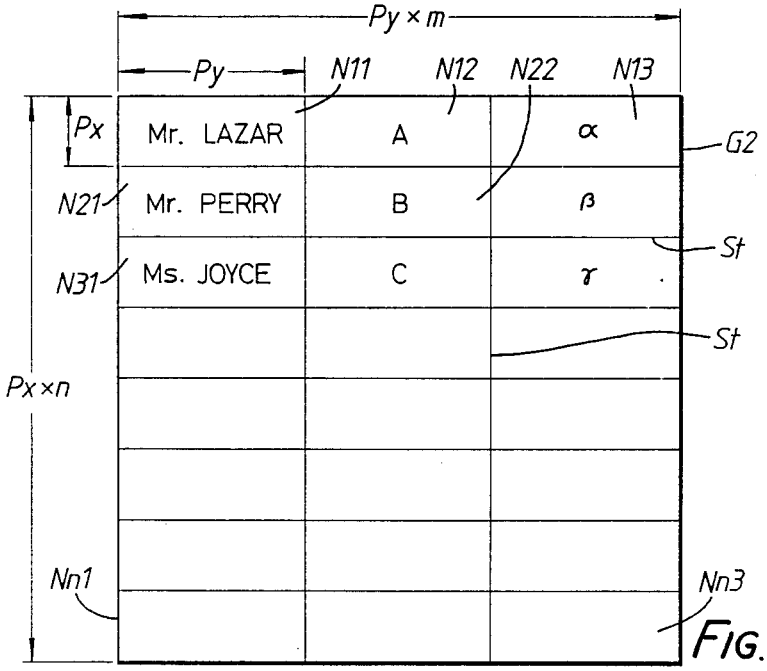

A main portion of the first embodiment of the present invention will now be descried. In this invention, an image on a second original document can be formed by editing (composing) it in a required position on a first original document. FIG. 4A shows a first document G1. An area En for entering listed items as direction names is provided on a part of this first original document G1. FIG. 4B shows a second original document G2. The listed items such as direction names are arrayed on this second original document G2 in the vertical and horizontal directions. The pitch of this array of items is taken as, for example, Px in the vertical direction and Py in the horizontal direction, thus Pxx n items are arrayed in the vertical direction, and Pyx m items in the horizontal direction. Although these array pitches are changeable, in this embodiment, there are two kinds of array pitches, i.e., first array pitch and second array pitch. These first and second array pitches are prestored in main processor group 71. First array pitch is selected by depression of list designating key **30*h*, and second array pitch is selected by depression of list designating key 30*i*. The pitch Px in the vertical direction is set at an integral multiple of the drive pitch of pulse motor 67 which drives lens block 8, while the pitch Py in the horizontal direction is set at an integral multiple of the drive pitch of pulse motor 33** which drives first carriage $41_1$.

Figure 1:
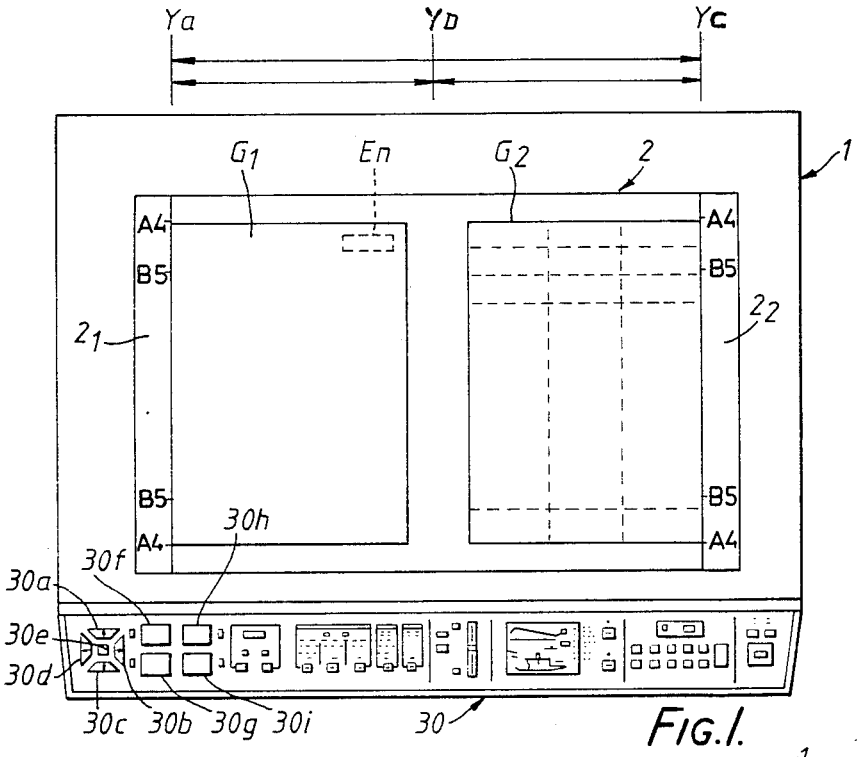
Figure 3A:
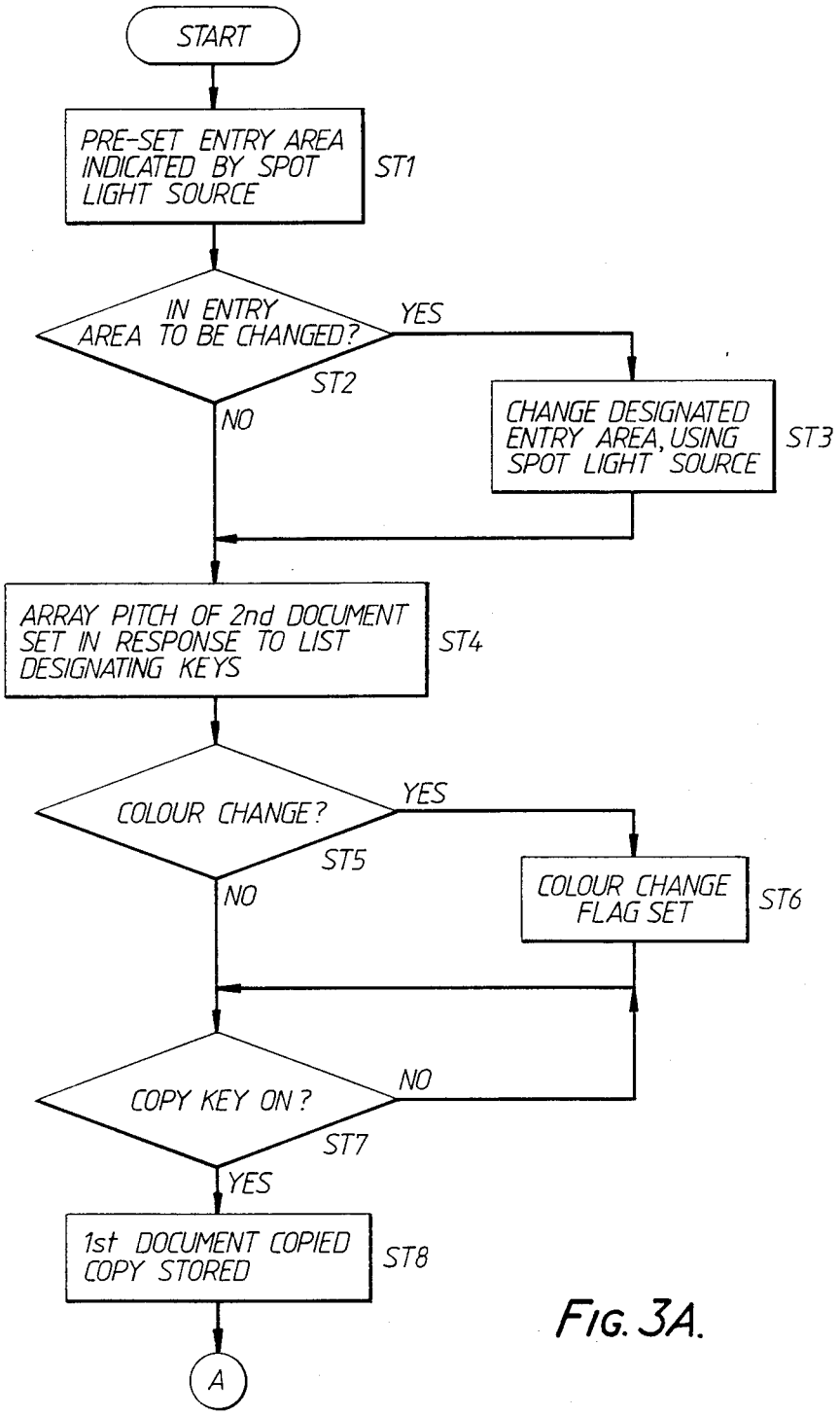
FIGS. 3A and 3B explain the steps in the working of the apparatus.
Figure 3B:
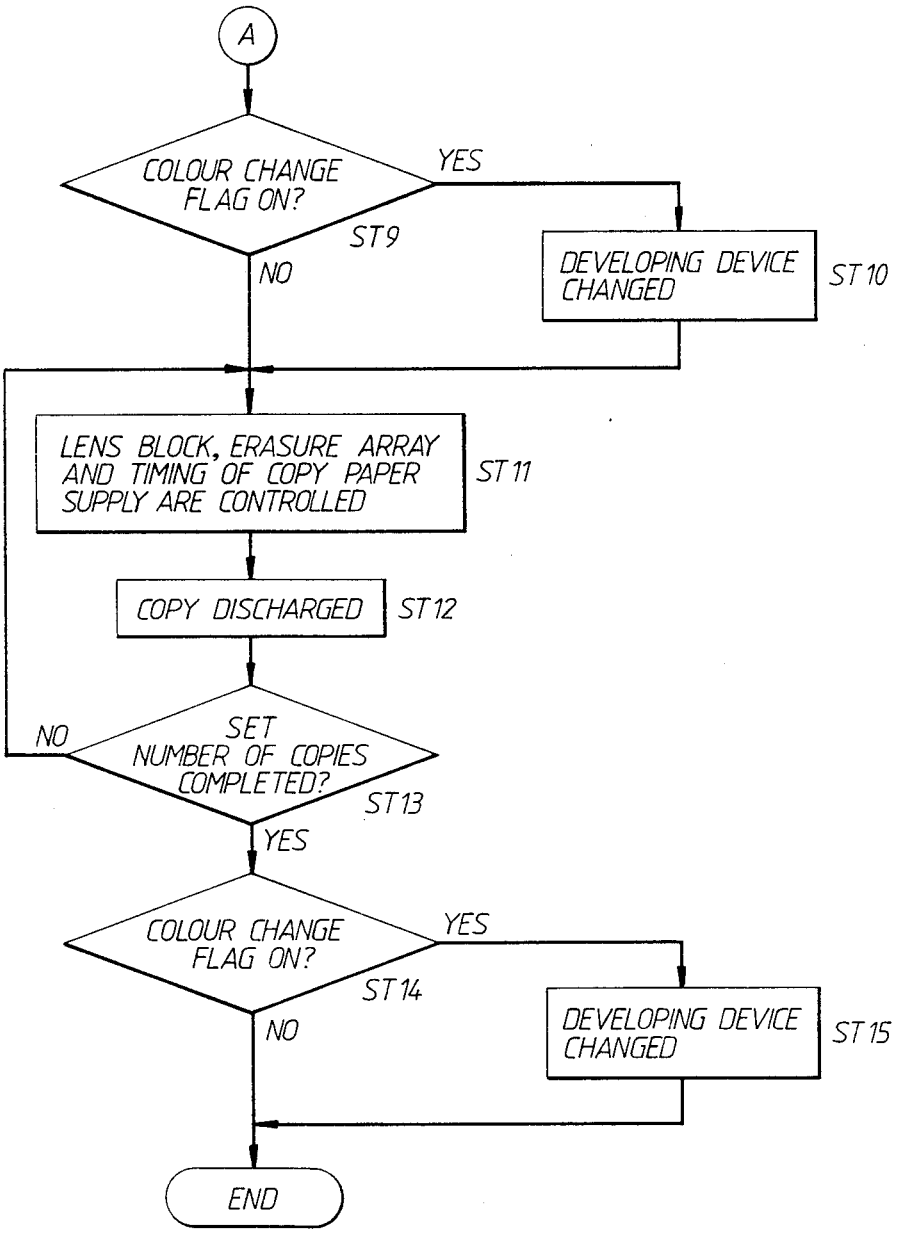

The operation of composite copying with the construction described above will now be explained. In this operation, original documents G1 and G2 are placed reverse side up, original document G1 to the side with fixed scale $2_1$ and original document G2 to the side with fixed scale $2_2$, as shown in FIG. 1. In this state the number of copies to be made is set by means of keyboard $30_2$ on control panel 30. Array pitches of item images in second original document G2 placed on table 2, are designated by the operation of list designating keys **30*h* or 30*i*. That is, one of list designating keys 30*h* and 30*i* is selectively depressed corresponding to array pitch of listed items in second original document G2. Then, if insertion designating key 30*f* is operated, main processor group 71 sets composite copying mode as shown in FIG. 3**.

Figure 2:
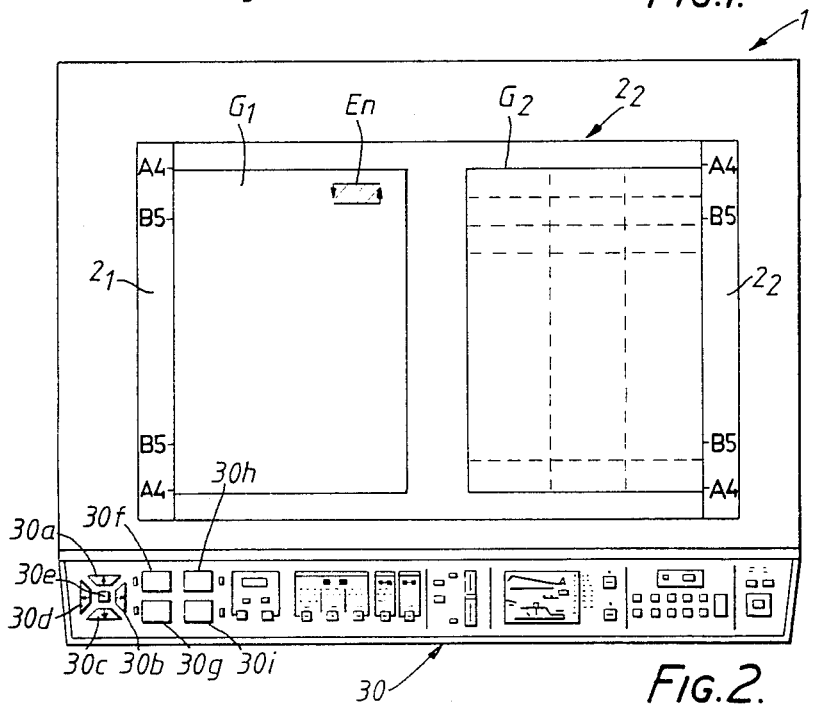

First, in step ST1, spot light source 131 is turned on. This spot light source 131 is moved to the area corresponding to list item entry area En, which has been prestored by main processor group 71, and entry area En is indicated on first original document G1 by the light passing through it. Next, in step ST2, the system checks whether or not control keys **30*a*–30*d* which move the spot light source 131 have been operated. If control keys 30*a*–30*d* have been operated, then in step ST3 spot light source 131 is turned on as described above, and moved in response to the operation of control keys 30*a*–30*d* as shown in FIG. 2**.

When position designating key **30*e* is operated with spot light source 131 in the required position, entry area En corresponding to that position is stored by main processor group 71. After the operation of changing entry area En has been completed in this way, or when control keys 30*a*–30*d* have not been operated, control moves to step ST4. In this step ST4, the system checks which one of list designating keys 30*h* or 30*i* has been selected. An array pitch of second original document corresponding to selected the list designating key, is set. Then, in step ST5, the system checks whether or not color change key 30*g* has been operated. If color change key 30*g* has been operated, the color change flag is set in step ST6, while if color change key 30*g* has not been operated, control passes to step ST7. In this step ST7, the system checks whether or not copy key $30_1$ has been operated. If copy key $30_1$ has been operated, in step ST8 first carriage $41_1$ moves across the area Ya to Yb in FIG. 1, and first original document G1** is copied in the usual manner by the operations described earlier.

The paper onto which the image of first original document G1 has been copied is then conveyed to multicopying unit 28 and held in storage unit **28*a*. When the set number of copies of first original document G1 have been made, control passes to step ST9. In this step ST9, the status of the color change flag mentioned above is checked. If this flag is ON, in step ST10 the change is made from developing device $12_2$, in which black toner is stored, to developing device $12_1$, in which red toner is stored. Then control passes to step ST11. In this step ST11, second original document G2 is scanned, and erasure array 150 and lens block 8 are operated, and the list item (direction name) designated on second original document G2 is copied on to entry area En of successive sheets sent back to the copying unit from storage unit 28*a***.

Figure 5A:
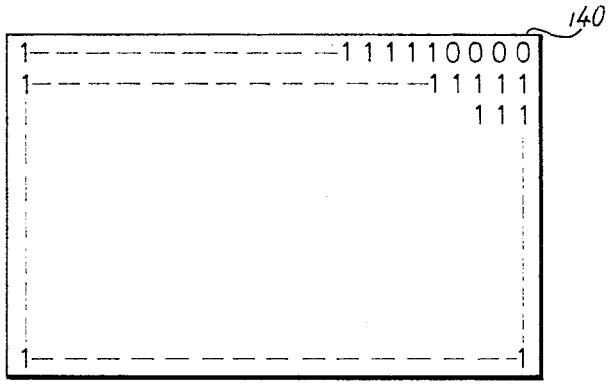
FIGS. 5A–5C are plan views for explaining memory contents.

Specifically, first of all first carriage $41_1$ is moved across the area from Yb to Yc shown in FIG. 1, thus scanning second original document G2. As this takes place, list image N11 in second original document G2, as shown in FIG. 4B, is formed on the first sheet of paper. Pulse motor 67 is driven by main processor group 71 in response to the array pitch of the designated image on second original document G2, and lens block 8 is moved so that the image of list item N11 is formed in the entry area En of the copy paper. Further, low level signals are stored in the storage area of memory 140 corresponding to N11 on second original document G2, and high level signals are stored in the storage areas other than those for N11, as shown in FIG. 5A.

Figure 6A:
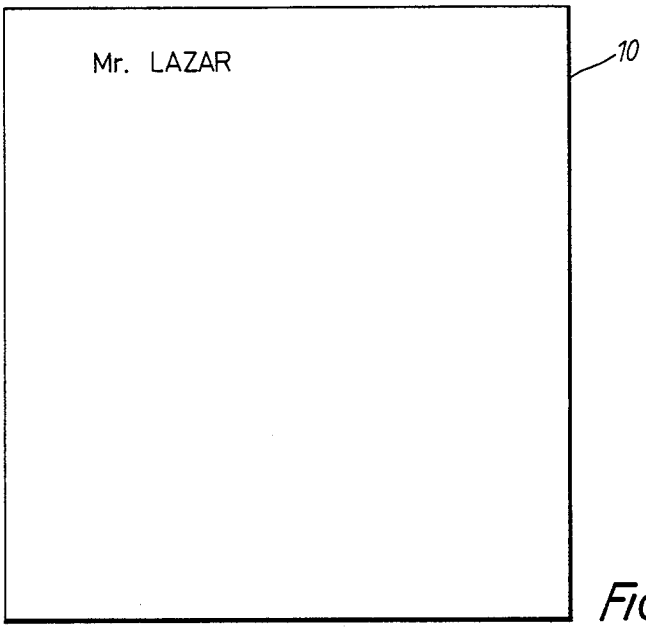
FIGS. 6A and 6B are plan views for explaining composite copying.
Figure 6B:
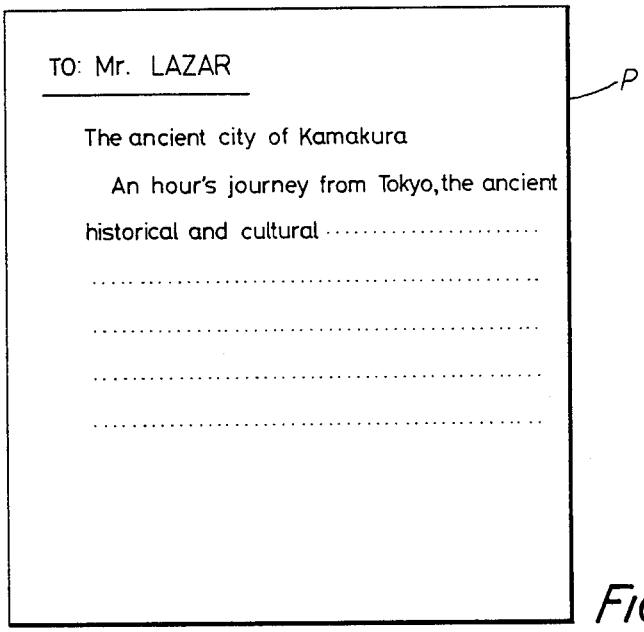

The data stored in this memory 140 are read in synchronism with the operation of first carriage $41_1$, and supplied to array drive unit 160. The result is that only an image corresponding to N11 on second original document G2 is formed on the surface of photosensitive drum 10, as indicated in FIG. 6A. This image formed on photosensitive drum 10 is transferred on to copy paper supplied in synchronism with the rotation of photosensitive drum 10. Thus the image of N11 on second original document G2 is formed in the entry area En of this copy paper, as indicated in FIG. 6B. The image is formed by red toner when color change key **30*g* is operated, and by black toner when color change key 30*g* is not operated. In step ST12, copy paper P on to which the images of first original document G1 and second original document G2 have been composite copied is discharged onto tray 25**.

Figure 5B:
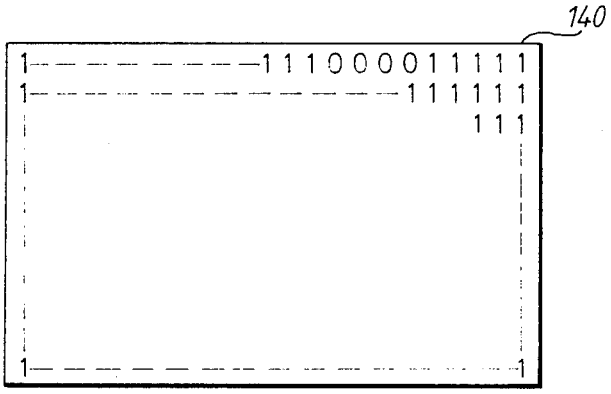

Next, in step ST13, the system checks as to whether or not composite copying of the set number of copies has been completed. If it has not been completed, control passes to step ST11, and composite copying proceeds as described above. Lens block 8 is moved so that the image of N21 as indicated in FIG. 4B, is formed on the second sheet of paper, in entry area En of first original document G1, in addition to which erase data are stored in memory 140, as indicated in FIG. 5A, so that images other than N21 are erased from photosensitive drum 10 by erasure array 150. Lens block 8 is then moved again, so that the image of N31 on second original document G2 is formed on the third sheet of paper, in addition to which erasure array 150 is controlled so that images other than N31 are erased. Lens block 8 is then moved again so that the image of N12 on second original document G2 is formed also on (n+1)th sheet of paper, in addition to which erase data are stored by memory 140, as indicated in FIG. 5B, so that images other than N12 are erased.

Figure 5C:
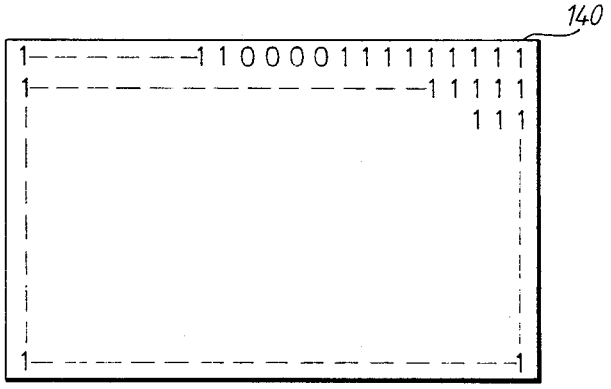

Erase data corresponding to a list image N13 are stored by memory 140 as indicated in FIG. 5C.

The timing of the supply of paper P supplied from storage unit 28*a* to the transferring station is changed for each horizontal line by an integral multiple of pitch Py, and controlled so that the prescribed image on second original document G2 coincides with entry area En of the paper P supplied. Thereafter, composite copying of list items designated proceeds in the same manner. When the system has checked in step ST13 that all copying has been completed, in step ST14 the status of the color change flag is checked, and when this flag is ON, in step ST15 the developing device $12_2$ in which the black toner is stored is returned to its set state, and all processing is completed.

According to the first embodiment described above, arrayed images on second original document G2 can be composed on to entry area En of first original document G1. A different list item (direction name, etc.) can be entered automatically on each copy, which is a great practical convenience.

A further convenience is that the position at which material on second original document G2 is entered on first original document G1 can be varied at will simply.

Moreover, in the case of the embodiment described above, the explanation dealt with the entry on first original document G1 of particular direction names on second original document G2, but the actual material on second original document G2 is not restricted to these direction names.

Further, in the embodiment described above, paper onto which an image had been copied once was sent back to the copying unit by multicopying unit 28, but the arrangement can be such that paper onto which an image has been copied once is held in the paper feed cassette and sent back for the edit copying operation from this cassette, without using multicopying unit 28.

Moreover, photosensitive drum 10 applied to the embodiment described above is a selenium (Se) system, and this photosensitive drum is highly sensitive to light of blue color values. Consequently, if the frames St demarcating the listed items N11–Nn3 on second original document G2 as shown in FIG. 4B are formed in blue ink, a frame St can be made not to appear in the image formed on the copy paper, even if the position in which second original document G2 is placed is slightly out of alignment with document table 2.

Figure 31:
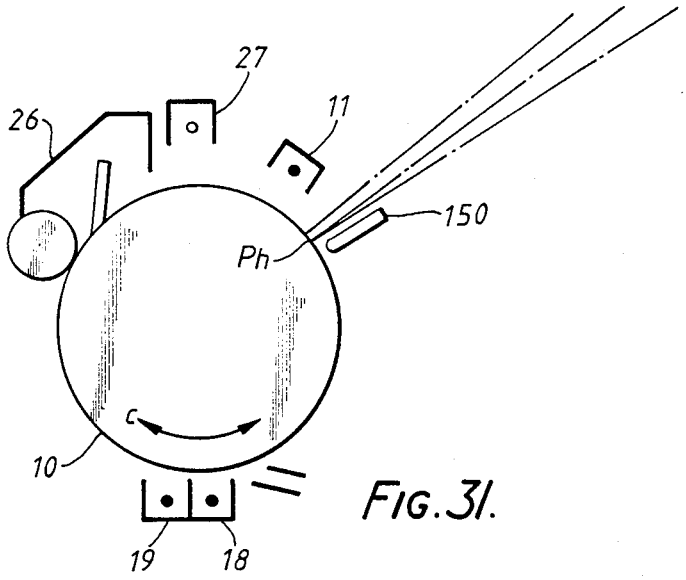

Furthermore, the position of erasure array 150 is not restricted to that shown in FIG. 25. It can be disposed between exposure unit Ph and developing device $12_1$, as shown in FIG. 31, and may be constructed so that it erases a formed electrostatic latent image in response to a specific designation.

As described above, the first embodiment of the invention provides an image forming apparatus which can form an image on a copy medium by combining an image from a prescribed area of a first original document with an image from another document.

A second embodiment of the present invention will be described hereinafter. If no description is given, the constitution of the second embodiment is the same as that of the first embodiment.

FIG. 37 shows a control panel 30' used in a second embodiment of the present invention. Control panel 30' carries thereon an insertion center-point designating key 30*f'* for altering the insertion portion on an original document when carrying out composite copying. A list number designating key 30*i'* for designating the number corresponding to the listed item in the document to be inserted (see FIG. 34B). When carrying out composite copying, the corresponding number of the listed item to be taken from the second document G2 is designated by the operation of a keyboard $30_2$ after depressing list number designating key 30*i'*.

Figure 34A:
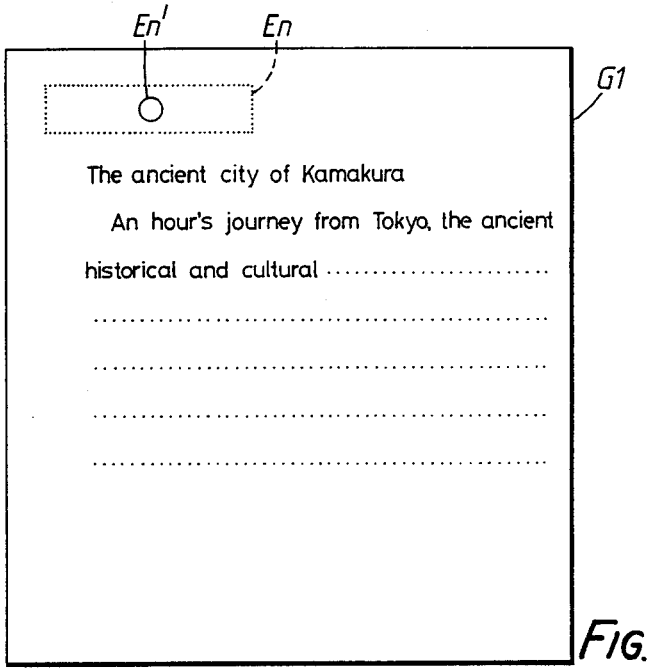
FIGS. 34A and 34B show the first and second documents respectively.
Figure 34B:
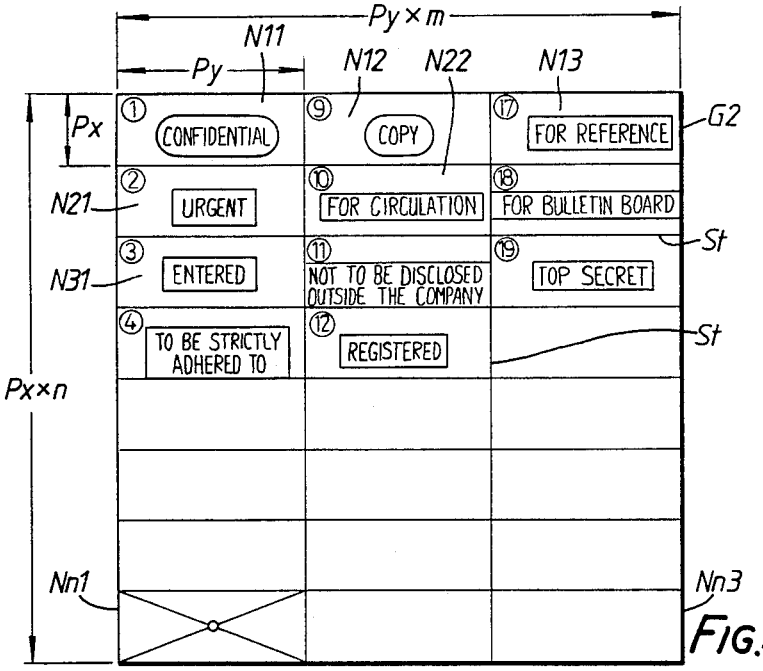

A main portion of the second embodiment of the present invention will now be described. In this invention, an image on a second original document can be formed by composing it in a required position on a first original document. FIG. 34A shows a first original document G1. An area En for entering listed items ("For Circulation", "Confidential", etc.) is provided on a part of this first original document G1. FIG. 34B shows a second original document G2. The listed items such as "Confidential", "Urgent", "Copy", "For Circulation", etc. are arrayed on this second original document G2, e.g., in the vertical and horizontal directions. The pitch of this array of items is taken as, for example, Px in the vertical direction and Py in the horizontal direction, thus PxX n items are arrayed in the vertical direction, and Pyx m items in the horizontal direction. These array pitches are prestored in main processor group 71. The pitch Px in the vertical direction is set at an integral multiple of the drive pitch of pulse motor 67 which drives lens block 8. The pitch Py in the horizontal direction is set at an integral multiple of the drive pitch of pulse motor 33 which drives first carriage $41_1$.

Figure 32:
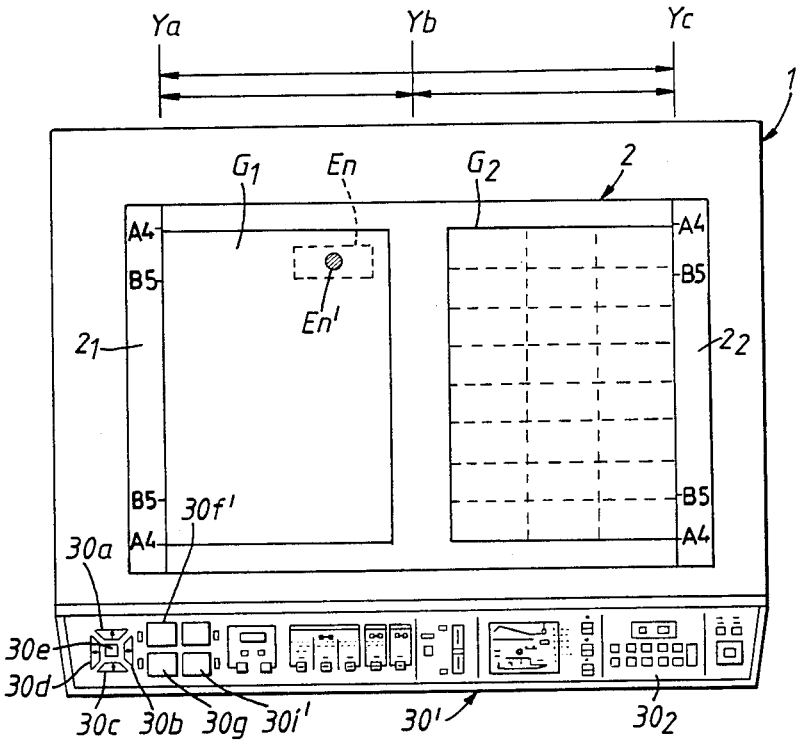
Figure 33A:
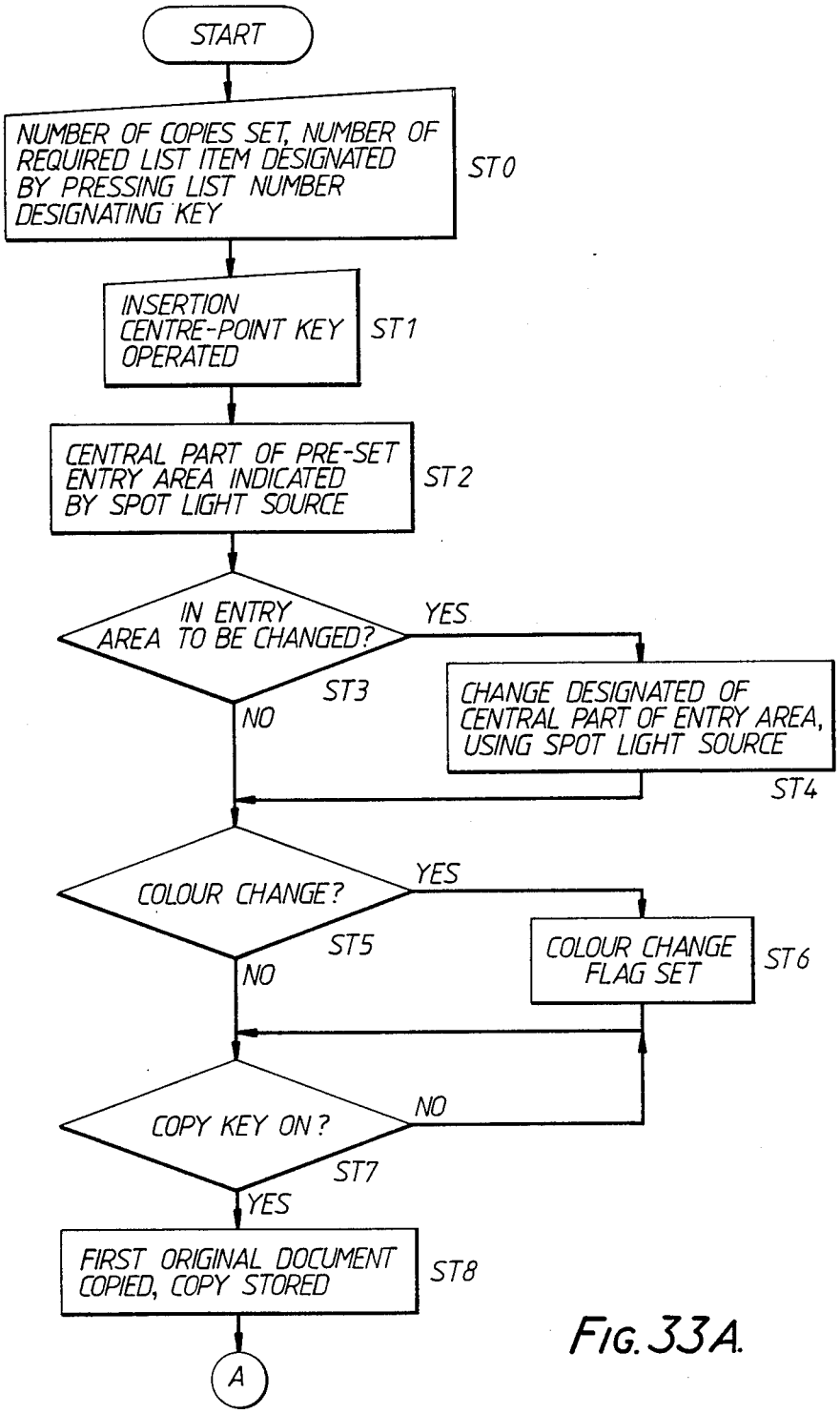
FIGS. 33A and 33B explain the steps in the working of the apparatus.
Figure 33B:
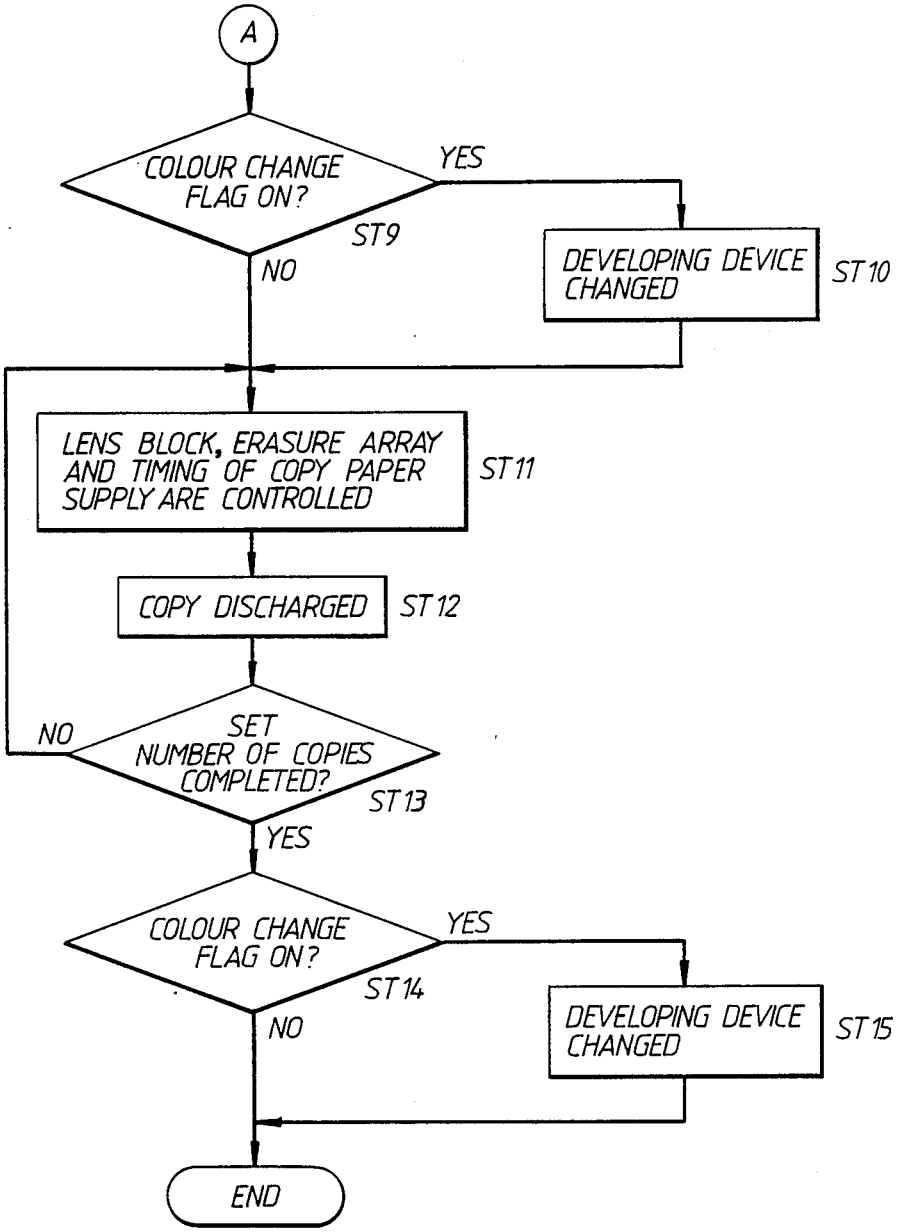

The operation of composite copying with the construction described above will now be explained. In this operation, original documents G1 and G2 are placed reverse side up, original document G1 to the side with fixed scale $2_1$ and original document G2 to the side with fixed scale $2_2$, as shown in FIG. 32. In this state the number of copies to be made is set by means of keyboard $30_2$ on control panel 30', list number designating key 30*i'* is operated, and the corresponding number of the item which it is desired to be copied is designated by means of keyboard $30_2$ (STO). When for example "10" has been set by keyboard $30_2$, "For Circulation" is designated for composite copying onto the entry area En of first original document G1. After designation of the item required to be copied, insertion center-point designating key 30*f'* is operated (ST1), which sets main processor group 71 to composite copying mode, and the operations shown in FIGS. 33A and 33B are carried out.

First, in step ST2, spot light source 131 is turned on. This spot light source 131 is moved to central part (center point) En' of list item entry area En, which has been prestored by memory 140, and central part En' of entry area En is indicated on first original document G1 by the light passing through it. In this step, central part En' of entry area En and center point $\phi$ of the appropriate list frame (St) of second original document G2 (see FIG. 34B) correspond. Next, in step ST3, the system checks whether or not control keys 30a–30d which move the spot light source 131 have been operated. If control keys 30a–30d have been operated, then in step ST4 spot light source 131 is turned on as described above, and moved in response to the operation of control keys 30a–30d as shown in FIG. 32.

When position designating key 30e is operated with spot light source 131 in the required position, entry area En corresponding to that position, i.e., central part En', is stored by main processor group 71. After the operation of changing entry area En has been completed in this way, or when control keys 30a–30d have not been operated, control moves to step ST5. In this step ST5, the system checks to whether or not color change key 30g has been operated. If color change key 30g has been operated, the color change flag is set in step ST6, while if color change key 30g has not been operated, control passes to step ST7. In step ST7, the system checks as to whether or not copy key 30 has been operated. If copy key 30 has been operated, in step ST8 first carriage $41_1$ moves across the area Ya to Yb in FIG. 32, and first original document G1 is copied in the usual manner by the operations described earlier.

The paper onto which the image of first original document G1 has been copied is then conveyed to multicopying unit 28 and held in storage unit 28a. When the set number of copies of first original document G1 have been made, control passes to step ST9. In this step ST9, the status of the color change flag mentioned above is checked. If this flag is ON, in step ST10 the change is made 35 from developing device $12_2$, in which black toner is stored, to developing device $12_1$, in which red toner is stored. Then control passes to step ST11. In this step ST11, second original document G2 is scanned, and erasure array 150 and lens block 8 are operated, and the list item of the number designated on second original document G2 is copied onto entry area En of successive sheets sent back to the copying unit from storage unit 28a.

Specifically, first of all first carriage $41_1$ is moved across the area from Yb to Yc shown in FIG. 32, thus scanning second original document G2. As this takes place, list image N22, which corresponds to the number "10" in second original document G2, as shown in FIG. 34B, is formed on the first sheet of paper. Pulse motor 67 is driven by main processor group 71 in response to the array pitch of the designated image on second original document G2, and lens block 8 is moved so that the image of list item N22, corresponding to the number "10", is formed in the entry area of En of the copy paper. Further, low level signals are stored in the storage area of memory 140 corresponding to N22 on second original document G2, and high level signals are stored in the storage areas other than those for N22, as shown in FIG. 35.

Figure 36A:
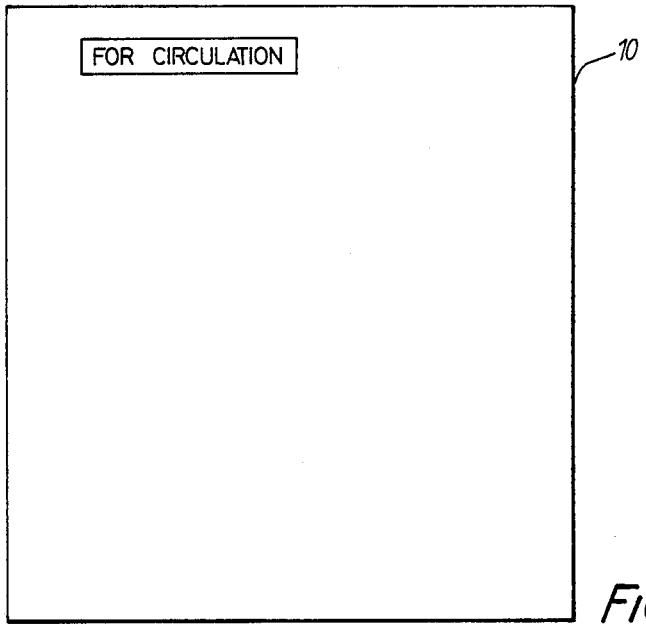
FIGS. 36A and 36B are plan views for explaining composite copying.
Figure 36B:
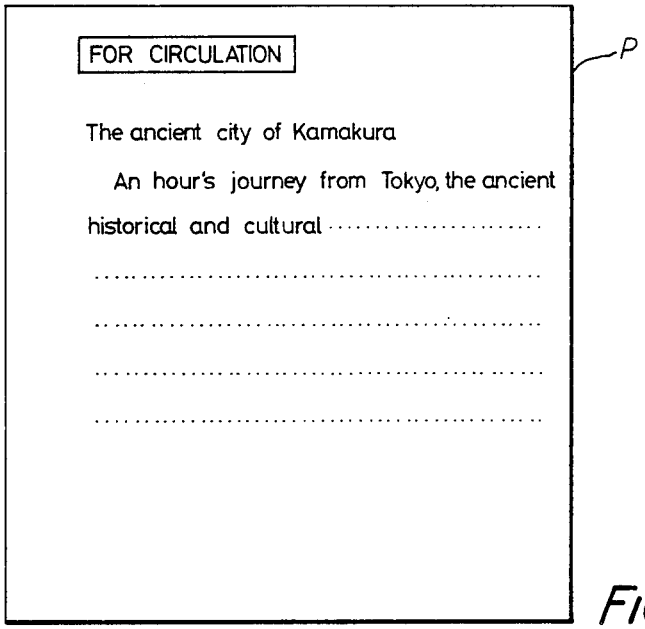

The data stored in this memory 140 are read in synchronism with the operation of first carriage $41_1$, and supplied to array drive unit 160. The result is that only an image corresponding to N22 on second original document G2 is formed on the surface of photosensitive drum 10, as indicated in FIG. 36A. This image formed on photosensitive drum 10 is transferred onto copy paper supplied in synchronism with the rotation of photosensitive drum 10. Thus the image of N22, corresponding to the number "10" on second original document G2 ("For Circulation") is formed in the entry area En of this copy paper, as indicated in FIG. 36B. The composition is such that central part En' of entry area En and center point $\phi$ of the relevant list frame (St) coincide. The image is formed by red toner when color change key 30g is operated, and by black toner when color change key 30g is not operated. In step ST12, copy paper P onto which the images of first original document G1 and second original document G2 have been composite copied is discharged onto tray 25.

Next, in step ST13, the system checks as to whether or not composite copying of the set number of copies has been completed. If it has not been completed, control passes to step ST11, and composite copying proceeds as described above. Lens block 8 is moved so that the image of N22, corresponding to the number "10" as indicated in FIG. 34B, is formed on the second sheet of paper, in entry area En of first original document G1, in addition to which erase data are stored in memory 140, as indicated in FIG. 34, so that images other than N22, which corresponds to the number "10", are erased from photosensitive drum 10 by erasure array 150.

Lens block 8 is then moved again, so that the image of N22, corresponding to the number "10" in second original document G2, is formed on the third sheet of paper, in addition to which erasure array 150 is controlled so that images other than N22, which corresponds to the number "10", are erased. Lens block 8 is then moved again so that the image of N22, corresponding to the number "10" in second original document G2, is formed also on (n+1)th sheets of paper, in addition to which erase data are stored by memory 140, as indicated in FIG. 35, so that images other than N22, which corresponds to the number "10", are erased.

The timing of the supply of paper P supplied from storage unit 28a to the transferring station is changed for each horizontal line by an integral multiple of pitch Py, and controlled so that the prescribed image on second original document G2 coincides with entry area En of the paper P supplied. Thereafter, composite copying of list items corresponding to the numbers designated proceeds in the same manner. When the system has checked in step ST13 that all copying has been completed, in step ST14 the status of the color change flag is checked, and when this flag is ON, in step ST15 the developing device $12_2$ in which the black toner is stored is returned to its set state, and all processing is completed.

According to the second embodiment described above, one image of those arrayed on second original document G2 and designated by numbers can be composed onto entry area En of first original document G1. Since the same list item ("For Circulation", etc.) can be entered automatically on a plurality of copies, there is no need to have a stamp ready or to stamp each copy, which is a great practical convenience.

A further convenience is that the position at which material on second original document G2 is entered on first original document G1 can be varied at will simply by moving the central part En'(center point).

Although only a few exemplary embodiments have been described in detail above, those skilled in the art will readily appreciate that many modifications are possible in the preferred embodiments without materially departing from the novel teachings and advantages of this invention. Accordingly, all such modifications are intended to be included in this invention as defined by the following claims.

What is claimed is:

1. An image forming apparatus comprising:

an original table on which first and second original documents are placed, said first original document having an item area, and said second original document having listed items arrayed thereon;

an image carrier;

original scanning means, movable along said original table, for optically scanning said first and second original documents placed on said original table and for forming reflected light images thereof;

means for directing light images obtained by said original scanning means onto said image carrier;

first image forming means for forming electrostatic latent images corresponding to said focused images of said first and second original documents from said directing means onto said image carrier;

second image forming means for producing visible images on an image forming medium corresponding to said electrostatic latent images;

changing means for selectively changing the position at which said directing means directs an image corresponding to said second original document on said image carrier;

image erasing means for selectively erasing selected portions of said electrostatic latent images formed by said first image forming means;

image forming medium feed-back means for feeding said image forming medium after a visible image of said first original document has been produced thereon back to said second image forming means;

memory means for storing positional data of said item area of said first original document and sizes of listed items arrayed on said second original document; and controlling means for: (1) controlling said original scanning means, first image forming means, and second image forming means to form a visible image of said first original document on said image forming medium, (2) controlling said image forming medium feed-back means to feed said image forming medium on which the visible image of said first original document has been formed back to said second image forming means, (3) controlling said changing means to position a light image of one of said listed items arrayed on said second original document onto said image carrier, (4) controlling said image erasing means to erase the electrostatic latent image of said second original document outside of said light image of said one of said listed items, (5) controlling said original scanning means, first image forming means and second image forming means to form a visible image of said one of said listed items directed by said directing means on an area of said image forming medium corresponding to said item area, and (6) controlling said image forming medium feed-back means to feed said image forming medium having the visible image of said first original document to cause said item area of said first original document to coincide with the visible image of said listed item on said second original document formed on said image carrier.

2. An apparatus according to claim 1, further comprising:

specifying means for changing a location of said item area on said first original document placed on said original table.

3. An apparatus according to claim 2, wherein said specifying means includes:

spot light source provided so as to be moved in a first direction and second direction perpendicular to said first direction for emitting light through said first original document; and means operatively connected to said spot light source, for moving said source to corners of said item area of said first original document, in response to manually entered commands, positional data designated by said moving means of said corners of said item area being stored in said memory means.

4. An apparatus according to said claim 2, wherein said specifying means includes:

spot light source provided so as to be moved in a first direction and second direction perpendicular to said first direction for emitting light through said first original document; and means operatively connected to said spot light source, for moving said source to a center of said item area of said first original document, in response to manually entered commands, positional data designated by said moving means of said center of said item area being stored in said memory means.

5. An apparatus according to said claim 1, wherein said directing means includes:

lens means for passing said light images and directing said light images onto said image carrier.

6. An apparatus according to said claim 5, wherein said changing means includes:

a movable member to which said lens means is fixed; and a base plate provided so as to be moved in a first direction, said movable member being slidably mounted on said base plate so as to be moved in a second direction perpendicular to said first direction.

7. An apparatus according to said claim 1, wherein said image erasing means includes:

a plurality of light-emitting elements which are opposed to said image carrier and arranged in a row.

8. An apparatus according to claim 7, wherein said plurality of light-emitting elements are arranged at positions so as to selectively radiate said image carrier while said first image forming means is forming said electrostatic latent image of said one of said listed items on said second original document.

* * * * *